US008734170B2

(12) United States Patent
Ikeda et al.

(10) Patent No.: US 8,734,170 B2
(45) Date of Patent: May 27, 2014

(54) CONNECTOR ENGAGEMENT BODY

(75) Inventors: Tomohiro Ikeda, Kakegawa (JP); Ryuta Takishita, Kakegawa (JP); Kouichiro Mochizuki, Kakegawa (JP); Teruhiko Ohike, Kakegawa (JP); Sho Nogashira, Kakegawa (JP)

(73) Assignee: Yazaki Corporation, Tokyo (JP)

( * ) Notice: Subject to any disclaimer, the term of this patent is extended or adjusted under 35 U.S.C. 154(b) by 52 days.

(21) Appl. No.: 13/610,279

(22) Filed: Sep. 11, 2012

(65) Prior Publication Data

US 2013/0065412 A1 Mar. 14, 2013

(30) Foreign Application Priority Data

Sep. 12, 2011 (JP) ..... 2011-198034

(51) Int. Cl.
*H01R 13/62* (2006.01)

(52) U.S. Cl.
USPC ..... 439/157; 439/362

(58) Field of Classification Search
USPC ..... 439/157, 372, 924.1
See application file for complete search history.

(56) References Cited

U.S. PATENT DOCUMENTS

| | | | | |
|---|---|---|---|---|
| 5,441,420 | A * | 8/1995 | Okumura et al. | 439/157 |
| 6,174,179 | B1 | 1/2001 | Okabe | |
| 2004/0166719 | A1* | 8/2004 | Bernat et al. | 439/372 |
| 2011/0250770 | A1* | 10/2011 | Suzuki et al. | 439/157 |
| 2011/0312198 | A1* | 12/2011 | Komiyama et al. | 439/157 |
| 2012/0015547 | A1* | 1/2012 | Park | 439/372 |

FOREIGN PATENT DOCUMENTS

JP 11-307172 A 11/1999

* cited by examiner

*Primary Examiner* — Gary Paumen
(74) *Attorney, Agent, or Firm* — Sughrue Mion, PLLC

(57) ABSTRACT

A connector engagement body includes: a first connector including a first signal terminal and a first power supply terminal; a second connector including a power supply terminal locking portion, a signal terminal locking portion, a second signal terminal, and a second power supply terminal; and a lever including a signal terminal releasing portion, a power supply terminal releasing portion, a power supply terminal locked portion, and a signal terminal locked portion. The lever is engaged with the first connector and the second connector and causes a mating force and a separating force to act between the first connector and the second connector by moving between a mated position and a separated position relative to the first connector and the second connector.

7 Claims, 21 Drawing Sheets

CONNECTOR ENGAGEMENT BODY

BACKGROUND OF THE INVENTION

1. Field of the Invention

The present invention relates to a connector engagement body including a first connector and a second connector which, for example, relates to one having such a structure that the second connector connected to the first connector is disengaged by use of a lever.

2. Description of the Related Art

Conventionally, a lever engagement type connector (connector engagement body) having such a structure that rotating a lever separates, from a female connector, a male connector mated with the female connector by a rotational operation of the lever is known (see U.S. Pat. No. 6,174,179 B1).

In the above conventional connector engagement body, pressing a lever portion (operation portion) of a lock arm provided at the lever elastically deforms the lock arm to thereby unlock (pull out a lock protrusion from a lock hole), and then the lever is rotated with the operation portion being kept pressed, to thereby disengage the male connector from the female connector.

However, with the above conventional lever engagement type connector, since the lever is rotated with the operation portion kept pressed, a force in the direction of pressing the operation portion and a force in the direction of rotating the lever are necessary when disengaging the male connector from the female connector.

Further, it is so configured that the forces in the above two directions are applied only to the operation portion at a distal end of the lock arm to thereby press the operation portion and rotate the lever.

Thus, a problem arises that the lock arm of the lever may be damaged due to a great force (the force for elastically deforming the lock arm and the force for rotating the lever) applied to the lock arm of the lever.

Further, another problem arises that, since the lever is rotated with the lock arm kept elastically deformed, a repulsive force of the lock arm may prevent a smooth rotation of the lever.

Therefore, as a connector engagement body for solving the above problems, one as illustrated in FIGS. 23 to 25 has been proposed.

The connector engagement body 301 as illustrated in FIGS. 23 to 25 includes a first connector (for example, a service plug installation body) 303, a second connector (for example, a service plug) 305 and a lever 307. Further, the connector engagement body 301 is used by being installed on a midway of a conduction wire connecting a battery and a load (for example, motor) of a vehicle.

The first connector 303 includes a terminal 304 and is installed to be integrated with a base body (not illustrated, such as a body of the vehicle) by tightening tools such as bolts (not illustrated).

The second connector 305 includes a locking portion 311 and a terminal 306 (a terminal connected with the terminal 304 of the first connector 303) and is detachably and integrally connected with the first connector 303.

The lever 307 includes an operation portion (for example, a rotational operation portion) 313 and a locked portion 315 engageable with the locking portion 311 of the second connector 305.

The lever 307 is engaged with the first connector 303 and the second connector 305 and moves relative to the first connector 303 and the second connector 305, to thereby cause a mating force and a separating force to act between the first connector 303 and the second connector 305. In the connector engagement body 301, the lever 307 rotates relative to the second connector 305.

In addition to being rotatably engaged with the second connector 305, the lever 307 is so configured as to be engaged with the first connector 303 when the second connector 305 is caused to be connected with the first connector 303, when the second connector 305 has been connected with the first connector 303, and when the second connector 305 in a connected state is caused to be disconnected from the first connector 303. Then, although details will be described later, the lever 307 adapted to move relative to the first connector 303 and rotate relative to the second connector 305 is so made as to cause the mating force and the separating force to act between the first connector 303 and the second connector 305 (causing a downward and upward force for attaching and detaching the second connector 305 to and from the first connector 303).

With the connector engagement body 301, in the state that the locked portion 315 of the lever 307 is engaged with the locking portion 311 of the second connector 305, the second connector 305 is integrally connected with the first connector 303. From this state, it is configured such that a finger is used to press the locked portion 315 to thereby elastically deform the locked portion 315 by which the locked portion 315 is separated from the locking portion 311, and then the lever 307 is rotated to thereby separate the second connector 305 from the first connector 303. At this time, it is so configured that the finger abuts the operating portion 313 to rotate the lever 307 and to thereby apply a pressing force to the operating portion 313, thus making it possible to rotate the lever 307 in order to cause the separating force.

Here, the connector engagement body 301 will be explained in more detail.

For convenience of explanation, a height direction is defined as a moving direction of the second connector 305 when the second connector 305 is attached and detached to and from the first connector 303. Further, of the height direction, one direction (the second connector 305 side) is defined as an upper direction while the other direction (first connector 303 side) is defined as a lower direction. It is so configured that the second connector 305 moves toward the lower direction relative to the first connector 303 to be connected with the first connector 303 and the second connector 305 moves toward the upper direction relative to the first connector 303 to be disengaged from the first connector 303. Further, one direction perpendicular to the height direction is defined as a longitudinal direction, and one direction perpendicular to the height direction and the longitudinal direction is defined as a lateral direction.

The first connector 303 includes a first connector housing (not illustrated) made of an insulating material such as synthetic resin. The first connector housing includes a main body formed, for example, into a rectangular tube. The inner lower portion of the main body is provided with, for example, a terminal (female terminal) 304. The inner upper portion of the main body is provided with a connector chamber 333. The main body is provided with a pair of cam pins 334, as illustrated in FIG. 23.

The cam pins 334 protrude from outer walls (a pair of outer walls positioned on respective ends in the lateral direction) of the main body of the first connector 303.

The second connector 305 includes a second connector housing 335 made of an insulating material such as synthetic resin and a cover (electrical shock preventing cover) 337 made of an insulating material such as synthetic resin. The second connector housing 335 is provided with a terminal (male terminal) 306. Then, it is so configured that connecting the second connector 305 with the first connector 303 allows the second connector housing 335 to enter into the connector chamber 333 to thereby connect the terminal 306 of the second connector 305 with the terminal 304 of the first connector 303.

The cover 337 includes a body portion 343 (formed into a rectangular box provided with a tubular portion 339 and an upper plate portion 341), the locking portion 311 and a pair of rotational spindles 345.

When the second connector 305 is connected with the first connector 303, the cover 337 covers an upper portion of the first connector 303 to thereby lid the upper portion of the first connector 303. In addition, the second connector 305 is entered into the connector chamber 333.

Further, when the second connector 305 is connected with the first connector 303, the tubular portion 339 of the cover 337 surrounds a portion at an upper end side of the first connector housing. The cam pins 334 are positioned downward of the cover 337, as illustrated in FIG. 23.

The rotational spindles 345 are provided pairwise and protrude from outer walls (a pair of outer walls positioned at respective ends in the lateral direction) of the cover 337. Further, the rotational spindles 345 are positioned in the middle portion of the cover 337 in the height direction and longitudinal direction.

The lever 307 is made of an insulating material such as synthetic resin and includes a lever main body 323 (provided with a pair of arm portions 347 and a connecting portion 349 and formed into a U-like shape), the operating portion 313, the locked portion 315, cam grooves 357 and engaging holes (rotational spindle engaging holes) 359.

Each of the cam grooves 357 extends in the longitudinal direction of each of the arm portions 347 and is provided at each of the arm portions 347. The penetrating direction of each of the cam grooves 357 is the lateral direction of the lever 307 (lateral direction of the connector engagement body 301). Each of the engagement holes (penetration holes) 359 is provided at each of the arm portions 347 at the middle portion in the longitudinal direction of each of the arm portions 347. The penetrating direction of each of the engagement holes 359 is also the lateral direction of the lever 307. Further, each of the engagement holes 359 is separated from each of the cam grooves 357 in the thickness direction of the lever 307 which is a direction perpendicular to each of the longitudinal direction of the arm portion 347 and the longitudinal direction of the connecting portion 349. Further, with the connector engagement body 301 having the lever 307 in the mated position (refer to FIGS. 25A and 25B), the engagement holes 359 are positioned upward of the cam grooves 357.

It is so configured that, with the lever 307 installed at the cover 307, the rotational spindles 345 enter into the engagement holes 359 and the lever 307 rotates around the rotational spindles 345. Further, the rotational angle of the lever 307 is in the range of approximately 90 degrees, as illustrated in FIGS. 24 and 25.

Further, when the second connector 305 (cover 337) with the lever 307 installed thereto is connected with the first connector 303, the cam pins 334 of the first connector 303 are inserted into the cam grooves 357.

Further, it is so configured that, with the cam pins 334 inserted into the cam grooves 357, the lever 307 rotates between the mated position (refer to FIGS. 25A and 25B) and the separated position (refer to FIGS. 24A and 24B) around the rotational spindles 345.

It is so configured that the above rotation of the lever 307 allows the cam pins 334 to move in the cam grooves 357 and causes the mating force or separating force to act between the second connector 305 and the first connector 303. That is, it is so configured that when the lever 307 rotates clockwise (direction of an arrow A24) from the state illustrated in FIG. 24B, the second connector 305 moves downward to be mated with the first connector 303. Further, it is so configured that when the lever 307 rotates counterclockwise (direction of an arrow A25) from the state illustrated in FIG. 25B, the second connector 305 moves upward to be separated from the first connector 303.

SUMMARY OF THE INVENTION

With the above conventional connector engagement body 301 in the mated state as illustrated in FIGS. 25A and 25B, deflecting the locked portion 315 disengages the locked portion 315 from the locking portion 311 and the lever 307 is caused to rotate, to thereby remove the second connector 305 from the first connector 303. This moves the terminal 306 away from the terminal 304.

Incidentally, there is such a case that a power supply circuit and a signal circuit are provided at the connector engagement body 301. That is, there is such a case that a terminal of the power supply (first power supply terminal) circuit and a terminal of a signal circuit (first signal terminal) are provided at the first connector 303 while a terminal of the power supply circuit (second power supply terminal) and a terminal of the signal circuit (second signal terminal) are provided at the second connector 305. And there is a case in which rotating the lever 307 connects or disconnects the first power supply terminal of the first connector 303 with or from the second power supply terminal of the second connector 305, and connects or disconnects the first signal terminal of the first connector 303 with or from the second signal terminal of the second connector 305.

The case in which the power supply circuit and the signal circuit are provided will be explained in further detail.

The power supply circuit includes the first power supply terminal provided at the first connector 303 (for example, the terminal 304) and the second power supply terminal provided at the second connector 305 (for example, the terminal 306). Likewise, the signal circuit includes the first signal terminal provided at the first connector 303 (for example, a terminal other than the terminal 304) and the second signal terminal provided at the second connector 305 (for example, a terminal other than the terminal 306).

And in the mated state as illustrated in FIGS. 25A and 25B, the first power supply terminal of the power supply circuit provided at the first connector 303 and the second power supply terminal of the power supply circuit provided at the second connector 305 are connected with each other, while the first signal terminal of the signal circuit provided at the first connector 303 and the second signal terminal of the signal circuit provided at the second connector 305 are connected with each other.

On the other hand, in the separated state as illustrated in FIGS. 24A and 24B, the second power supply terminal of the power supply circuit provided at the second connector 305 is separated from the first power supply terminal of the power supply circuit provided at the first connector 303, while the second signal terminal of the signal circuit provided at the second connector 305 is separated from the first signal terminal of the signal circuit provided at the first connector 303.

Further, in a predetermined middle state between the mated state as illustrated in FIGS. 25A and 25B and the separated state as illustrated in FIGS. 24A and 24B (when the lever 307 is positioned in a predetermined middle position between the mated position as illustrated in FIGS. 25A and 25B and the separated position as illustrated in FIGS. 24A and 24B), the second signal terminal of the signal circuit provided at the second connector 305 is separated from the first signal terminal of the signal circuit provided at the first connector 303, whereas the first power supply terminal of the power supply circuit provided at the first connector 303 and the second power supply terminal of the power supply circuit provided at the second connector 305 are connected with each other.

That is, between the mated state as illustrated in FIGS. 25A and 25B and the separated state as illustrated in FIGS. 24A and 24B, it is so configured that gradually separating the second connector 305 from the first connector 303 firstly allows the second signal terminal of the signal circuit provided at the second connector 305 to be separated from the first signal terminal of the signal circuit provided at the first connector 303 and subsequently allows the second power supply terminal of the power supply circuit provided at the second connector 305 to be separated from the first power supply terminal of the power supply circuit provided at the first connector 303.

Each terminal of the signal circuit constitutes a part of a signal switch of, for example, a relay (not illustrated). And it is so configured that, when the signal terminals of the signal circuit are connected with each other, a current flows through an operational coil of the above relay, and an iron piece of the relay is adsorbed to an iron core of the operational coil, to thereby allow a stationary contact to be conductive with a traveling contact provided at the iron piece. On the other hand, it is so configured that, when the signal terminals of the signal circuit are disconnected from each other, the current stops flowing through the operational coil of the above relay, and the iron piece of the relay is separated from the iron piece of the coil by a restoring force of a spring, to thereby separate, from the stationary contact, the traveling contact provided at the iron piece.

In the above structure, each power supply terminal of the power supply circuit, the traveling contact of the relay, and the stationary contact of the relay are connected in series. For example, the terminal 304 is connected with a load (e.g. motor) via a conductive wire, the terminal 306 is connected with the stationary contact of the relay via a conductive wire, and the moveable contact of the relay is connected with a battery via a conductive wire.

Thus, with the conventional connector engagement body 301 provided with the power supply circuit and the signal circuit, since the operation from breaking of the signal circuit to breaking of the power supply circuit is implemented by one-step lock (lock between the locking portion 311 and the locked portion 315), there is no distinctive time difference (time from the separation of the terminals of the signal circuit to the separation of the terminals of the power supply circuit is too short) and thus there is a problem that a spark may be caused at the time of the breaking of the signal circuit and the breaking of the power supply circuit.

The present invention has been made in view of the above problems. It is therefore an object of the present invention to provide a connector engaging body including a signal circuit and a power supply circuit and capable of preventing generation of arc at the time of breaking of the signal circuit and power supply circuit.

A connector engagement body according to a first aspect of the present invention includes: a first connector including a first signal terminal, and a first power supply terminal; a second connector including a power supply terminal locking portion, a signal terminal locking portion, a second signal terminal configured to be connected with the first signal terminal of the first connector when the second connector is mated with the first connector, and a second power supply terminal configured to be connected with the first power supply terminal of the first connector when the second connector is mated with the first connector; and a lever including a signal terminal releasing portion, a power supply terminal releasing portion, a power supply terminal locked portion configured to be locked to the power supply terminal locking portion of the second connector, and a signal terminal locked portion configured to be locked to the signal terminal locking portion of the second connector, the lever being configured that to be engaged with the first connector and the second connector, and to cause a mating force and a separating force to act between the first connector and the second connector by moving between a mated position and a separated position relative to the first connector and the second connector. When the lever is positioned in the mated position, the signal terminal locked portion is locked to the signal terminal locking portion with the first signal terminal and the second signal terminal connected with each other and the first power supply terminal and the second power supply terminal connected with each other. When the lever is positioned in a predetermined middle position between the mated position and the separated position, the first power supply terminal and the second power supply terminal are connected with each other and the first signal terminal and the second signal terminal are separated from each other. When the lever is positioned in the separated position, the first power supply terminal and the second power supply terminal are separated from each other and the first signal terminal and the second signal terminal are separated from each other. When the lever is positioned in the mated position, applying a force to the signal terminal releasing portion disengages the signal terminal locked portion from the signal terminal locking portion, thereby allowing the lever to be rotatable to the predetermined middle position. When the lever is positioned in the predetermined middle position, applying a force to the power supply terminal releasing portion disengages the power supply terminal locked portion from the power supply terminal locking portion, thereby allowing the lever to be rotatable to the separated position.

It is preferable that the lever include a lever side lock interference portion, and that, with the lever positioned in the mated position, applying a force to the power supply terminal releasing portion allow the lever side lock interference portion to be engaged with the power supply terminal locking portion, thereby disenabling the lever to rotate.

It is preferable that the signal terminal locked portion, the power supply terminal locked portion, and the power supply terminal releasing portion be each formed at a distal end portion of an elastic portion extending from the lever.

A connector engagement body according to a second aspect of the present invention includes: a first connector including a first signal terminal, and a first power supply terminal; a second connector including a power supply terminal releasing portion, a power supply terminal locked portion, a signal terminal locked portion, a second signal terminal configured to be connected with the first signal terminal of the first connector when the second connector is mated with the first connector, and a second power supply terminal configured to be connected with the first power supply terminal of the first connector when the second connector is mated with the first connector; and a lever including a signal terminal releasing portion, a power supply terminal locking portion to which the power supply terminal locked portion of the second connector is locked, and a signal terminal locking portion to which the signal terminal locked portion of the second connector is locked, the lever being configured to be engaged with the first connector and the second connector and to cause a mating force and a separating force to act between the first connector and the second connector by moving between a mated position and a separated position relative to the first connector and the second connector. When the lever is positioned in the mated position, the signal terminal locked portion is locked to the signal terminal locking portion with the first signal terminal and the second signal terminal connected with each other and the first power supply terminal and the second power supply terminal connected with each other. When the lever is positioned in a predetermined middle position between the mated position and the separated position, the first power supply terminal and the second power supply terminal are connected with each other and the first signal terminal and the second signal terminal are separated from each other. When the lever is positioned in the separated position, the first power supply terminal and the second power supply terminal are separated from each other and the first signal terminal and the second signal terminal are separated from each other. When the lever is positioned in the mated position, applying a force to the signal terminal releasing portion disengages the signal terminal locked portion from the signal terminal locking portion, thereby allowing the lever to be rotatable to the predetermined middle position. When the lever is positioned in the predetermined middle position, applying a force to the power supply terminal releasing portion disengages the power supply terminal locked portion from the power supply terminal locking portion, thus allowing the lever to be rotatable to the separated position.

It is preferable that the lever include a movable lock stopper, and that, with the lever positioned in the mated position, the power supply terminal releasing portion abuts the movable lock stopper, making the power supply terminal locked portion immovable by a force applied to the power supply terminal releasing portion.

A connector engagement body according to a third aspect of the present invention includes: a first connector including a first signal terminal, and a first power supply terminal; a second connector including a signal terminal locking portion, a power supply terminal locked portion, a power supply terminal releasing portion, a second signal terminal configured to be connected with the first signal terminal of the first connector when the second connector is mated with the first connector, a second power supply terminal configured to be connected with the first power supply terminal of the first connector when the second connector is mated with the first connector; and a lever including a signal terminal releasing portion, a power supply terminal locking portion to which the power supply terminal locked portion of the second connector is locked, and a signal terminal locked portion configured to be locked to the signal terminal locking portion of the second connector, the lever being configured to be engaged with the first connector and the second connector and to cause a mating force and a separating force to act between the first connector and the second connector by moving between a mated position and a separated position relative to the first connector and the second connector. When the lever is positioned in the mated position, the signal terminal locked portion is locked to the signal terminal locking portion with the first signal terminal and the second signal terminal connected with each other and the first power supply terminal and the second power supply terminal connected with each other. When the lever is positioned in a predetermined middle position between the mated position and the separated position, the first power supply terminal and the second power supply terminal are connected with each other and the first signal terminal and the second signal terminal are separated from each other. When the lever is positioned in the separated position, the first power supply terminal and the second power supply terminal are separated from each other and the first signal terminal and the second signal terminal are separated from each other. When the lever is positioned in the mated position, applying a force to the signal terminal releasing portion disengages the signal terminal locked portion from the signal terminal locking portion, thereby allowing the lever to be rotatable to the predetermined middle position. When the lever is positioned in the predetermined middle position, applying a force to the power supply terminal releasing portion disengages the power supply terminal locked portion from the power supply terminal locking portion, thereby allowing the lever to be rotatable to the separated position.

It is preferable that the lever include a pair of arm portions and a connecting portion connecting the pair of arm portions with each other forming an alphabetical U-like shape, and the lever be configured to be rotatable relative to the second connector around a predetermined axis, and that each of the arm portions is provided with the power supply terminal locking portion.

The connector engagement body according to each of the aspects of the present invention includes a signal circuit and a power supply circuit, and brings about an effect that arc can be prevented in breaking the signal circuit or the power supply circuit.

DESCRIPTION OF THE EMBODIMENTS

Figure 1:
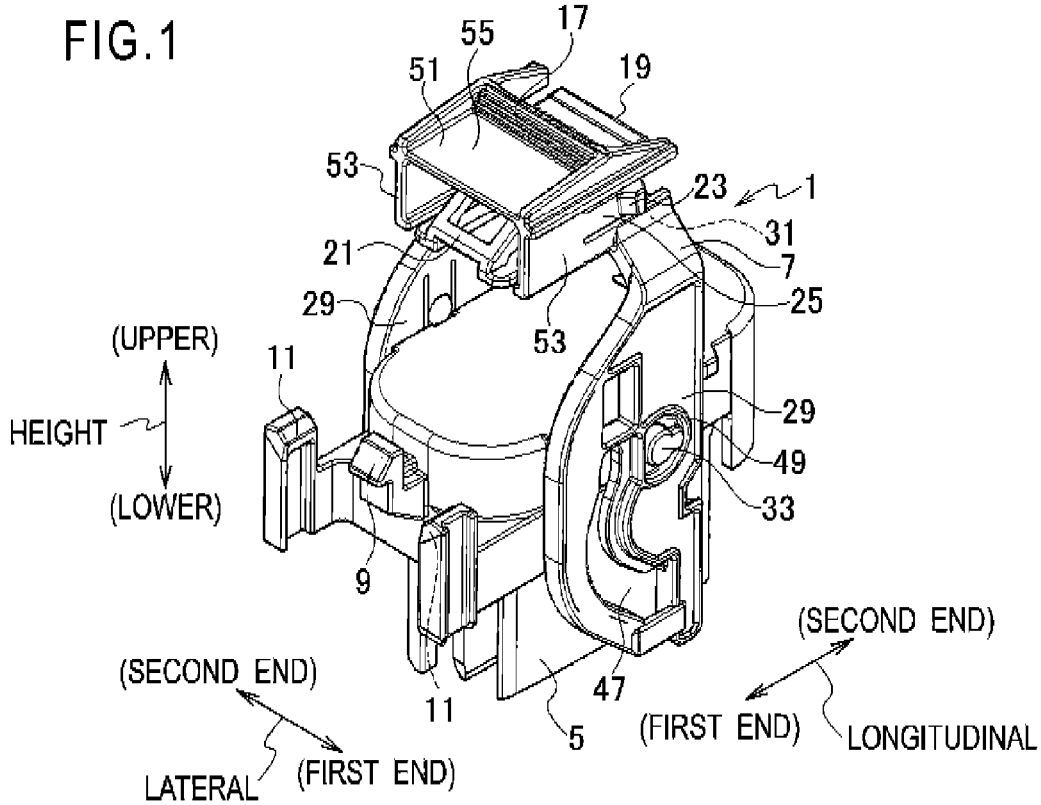
FIG. 1 is a perspective view of a connector engagement body (lever in a separated position) viewed from an upper portion, according to a first embodiment.
Figure 2:
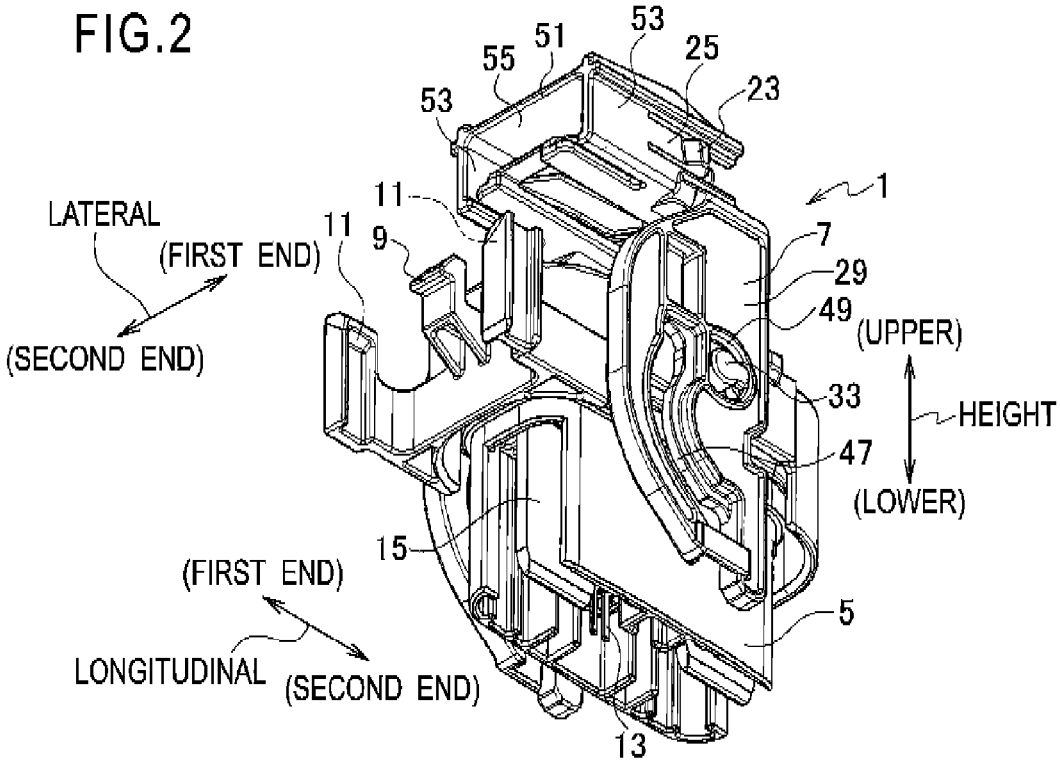
FIG. 2 is a perspective view of the connector engagement body (lever in the separated position) viewed from a lower portion, according to the first embodiment.

Hereinafter, embodiments of the present invention will be explained referring to the drawings.

First Embodiment

Referring to FIGS. 1 to 6, a first embodiment of the present invention will be explained.

Similarly to the conventional connector engagement body 301, a connector engagement body 1 according to the first embodiment includes a first connector (not illustrated, i.e., a service plug installation body which can be a base material or a base body), a second connector (i.e., a service plug) 5 and a lever 7. The connector engagement body 1 is used for example by being installed on a midway of a conductive wire for connecting a battery and a load (i.e., a motor) of a vehicle.

Similarly to the conventional connector engagement body 301, the connector engagement body 1 according to the first embodiment is so configured that moving (such as rotating) the lever 7 allows the second connector 5 to move in a direction to approach or to be separated from the first connector, to thereby implement mating and separating of the second connector 5 and the first connector.

The first connector includes a first signal terminal (female terminal) and a first power supply terminal (female terminal).

The second connector 5 includes a power supply terminal locking portion 9, signal terminal locking portions 11, a second signal terminal 13 (male terminal) and a second power supply terminal 15 (male terminal).

When the second connector 5 is mated with the first connector, the second signal terminal 13 is connected with the first signal terminal of the first connector. Likewise, when the second connector 5 is mated with the first connector, the second power supply terminal 15 is connected with the first power supply terminal of the first connector.

And the signal circuit becomes conductive when the second signal terminal 13 of the second connector 5 is connected with the first signal terminal of the first connector, while the signal circuit is broken when the second signal terminal 13 of the second connector 5 is separated from the first signal terminal of the first connector. Further, the power supply circuit becomes conductive when the second power supply terminal 15 of the second connector 5 is connected with the first power supply terminal of the first connector, while the power supply circuit is broken when the second power supply terminal 15 of the second connector 5 is separated from the first power supply terminal of the first connector.

Similarly to the conventional connector engagement body 301, the connector engagement body 1 according to the first embodiment has such a structure that each signal terminal (the first signal terminal of the first connector and the second signal terminal 13 of the second connector 5) of the signal circuit constitutes, for example, a part of a signal switch of a relay (not illustrated). And it is so configured that, when the first and second signal terminals of the signal circuit are connected with each other, a current flows through an operational coil of the relay, and an iron piece of the relay is adsorbed to an iron core of the operational coil, to thereby allow a stationary contact to be conductive with a traveling contact provided at the iron piece. On the other hand, it is so configured that, when the first and second signal terminals of the signal circuit are disconnected from each other, the current stops flowing through the operational coil of the relay, and the iron piece of the relay is separated from the iron core of the coil by a restoring force of a spring, to thereby separate, from the stationary contact, the traveling contact provided at the iron piece.

Further, the first and second power supply terminals of the power supply circuit and the traveling and stationary contacts of the relay are connected in series. For example, the first power supply terminal of the first connector is connected with the load (i.e., the motor) via a conductive wire, the second power supply terminal 15 of the second connector 5 is connected with the stationary contact of the relay via a conductive wire, and the moveable contact of the relay is connected with the battery via a conductive wire.

The lever 7 includes a signal terminal releasing portion 17, a power supply terminal releasing portion 19, a power supply terminal locked portion 21 configured to be locked to the power supply terminal locking portion 9 of the second connector 5, and signal terminal locked portions 23 configured to be locked to the signal terminal locking portions 11 of the second connector 5.

Similarly to the lever 307 of the conventional connector engagement body 301, it is so configured that the lever 7 is provided to rotate relative to the second connector 5, is engageable with the first connector via cam pins of the first connector, and moves between the mated position (refer to FIGS. 3A to 3C) and the separated position (refer to FIGS. 5A and 5B) relative to the first connector and the second connector 5 to thereby cause a mating force and a separating force to act between the first connector and the second connector 5.

It is so configured that, when the lever 7 is positioned in the mated position, the second connector 5 comes closest to the first connector, and the second connector 5 is mated integrally with the first connector, while the signal terminal locked portions 23 is locked to the signal terminal locking portions 11 and the first and second signal terminals are connected with each other and the first and second power supply terminals are connected with each other (it is configured such that the second signal terminal 13 of the second connector 5 is connected with the first signal terminal of the first connector, while the second power supply terminal 15 of the second connector 5 is connected with the first power supply terminal of the first connector).

It is so configured that, when the lever 7 is positioned in a predetermined middle position (refer to FIGS. 4A and 4B) between the mated position and the separated position, the second connector 5 is pulled out from the first connector by a predetermined amount, and the first and second power supply terminals are connected with each other, while the first and second signal terminals are separated from each other (it is configured such that the second signal terminal 13 of the second connector 5 is separated from the first signal terminal of the first connector, while the second power supply terminal 15 of the second connector 5 is connected with the first power supply terminal of the first connector).

It is so configured that, when the lever 7 is positioned in the separated position, the second connector 5 is substantially separated (in a separated state) from the first connector, and the first and second power supply terminals are separated from each other, while the first and second signal terminals are separated from each other (it is configured such that the second signal terminal 13 of the second connector 5 is separated from the first signal terminal of the first connector, while the second power supply terminal 15 of the second connector 5 is separated from the second power supply terminal of the first connector).

Further, it is so configured that, with the lever 7 positioned in the mated position and with the signal terminal locked portions 23 locked to the signal terminal locking portions 11, the lever 7 is prevented from being rotated with ease. When the lever is positioned in the mated position, applying a force (a pressing force depicted by an arrow A3*a* in FIG. 3B) to the signal terminal releasing portion 17 elastically deforms rod portions 25 supporting the signal terminal locked portions 23, disengages the signal terminal locked portions 23 from the signal terminal locking portions 11, and allows the lever 7 to rotate from the mated position to the predetermined middle position (refer to FIGS. 4A and 4B).

Further, it is so configured that, with the lever 7 positioned in the predetermined middle position and with the power supply terminal locked portion 21 locked to the power supply terminal locking portion 9, the lever 7 is unable to rotate to the separated position side. It is so configured that when the lever 7 is positioned in the predetermined middle position, applying a force (a force in the direction depicted by an arrow A4*a* in FIG. 4B) to the power supply terminal releasing portion 19 elastically deforms a base end side small arm portion 27 supporting the power supply terminal locked portion 21 and moves the power supply terminal locked portion 21 in the direction depicted by an arrow A4*b* in FIG. 4B, to thereby disengage the power supply terminal locked portion 21 from the power supply terminal locking portion 9. Then, it is so configured that the lever 7 is rotatable from the predetermined middle position to the separated position.

Similarly to the lever 307 of the conventional connector engagement body 301, the lever 7 includes a pair of arm portions 29 and a connecting portion 31 connecting the pair of arm portions 29 with each other, thus being formed in a U-like shape. The lever 7 has such a structure that a middle portion in the longitudinal direction of the pair of arm portions 29 is engaged with the second connector 5 and the lever 7 is rotatable around predetermined axes (rotational spindles 33 of the second connector 5) relative to the second connector 5.

The first connector (not illustrated) includes a first connector body in a form of a box. A connector mating chamber is formed inside the first connector body. The first signal terminal and first power supply terminal of the first connector are disposed in the connector mating chamber.

The second connector 5 includes a second connector body portion 35 and a cover (electrical shock preventing cover) 37 in a form of a box integrated with the second connector body portion 35. The cover is provided on one side (upper side) of the second connector body portion 35. A side wall portion 39 of the cover 37 surrounds the second connector body portion 35 at a predetermined distance away from the second connector body portion 35. The second signal terminal 13 and second power supply terminal 15 of the second connector 5 are provided at the second connector body portion 35.

When the lever 7 is positioned in the mated position to thereby mate the second connector 5 integrally with the first connector, the second connector body portion 35 enters into the connector mating chamber of the first connector to thereby allow the first and second signal terminals to be connected with each other and allow the first and second power supply terminals to be connected with each other.

When the lever 7 is positioned in the mated position to thereby mate the second connector 5 integrally with the first connector, the side wall portion of the first connector body enters into a gap between the side wall portion 39 of the cover 37 and the second connector body portion 35, and by sealing with a packing 41, the inside of the connector mating chamber (where each signal terminal and each power supply terminal are present) is shut off from outside thus accomplishing waterproof.

Note that, it is so made that the waterproof is maintained in a state that the lever 7 is positioned between the mated position and the separated side position or maintained in a state that the lever 7 is positioned between the mated position and a position in the neighborhood of the separated side position.

Figure 3A:
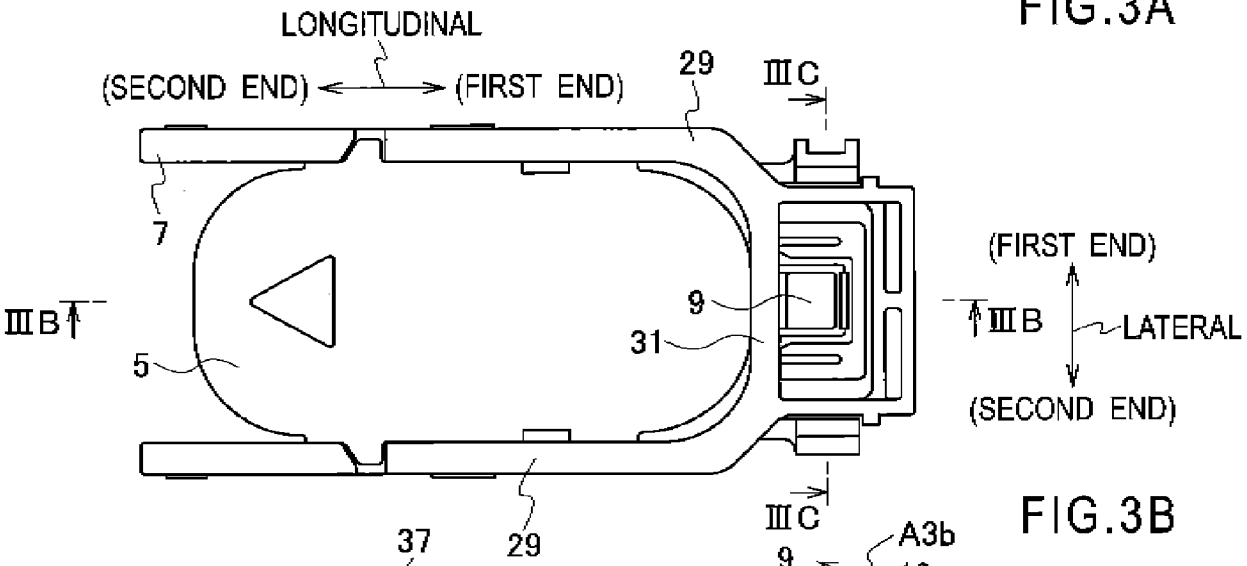
FIG. 3A is a plan view of the connector engagement body (lever in a mated position), according to the first embodiment.
Figure 3B:
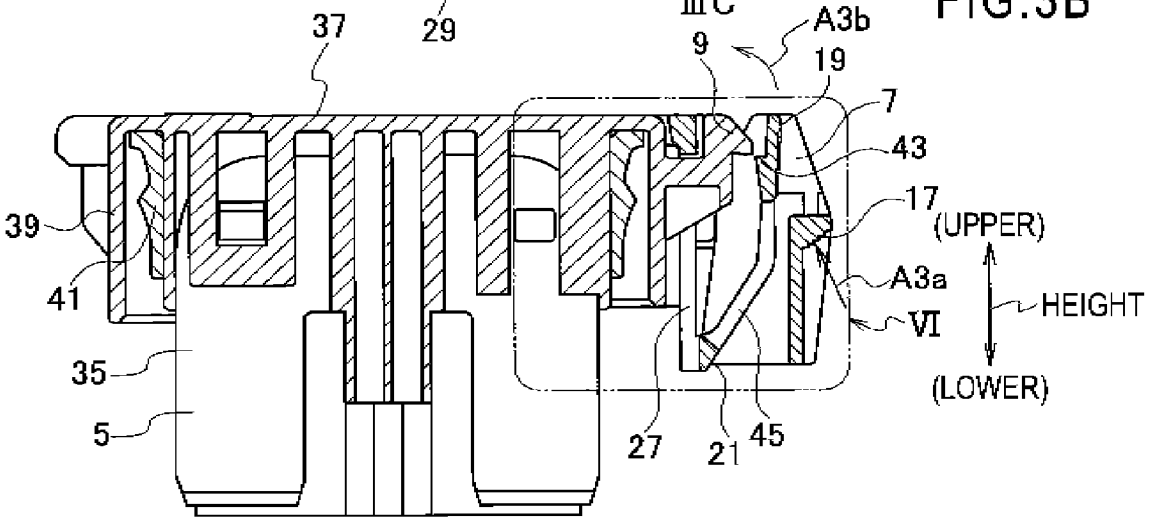
FIG. 3B is a cross sectional view taken along the line IIIB-IIIB in FIG. 3A.
Figure 3C:
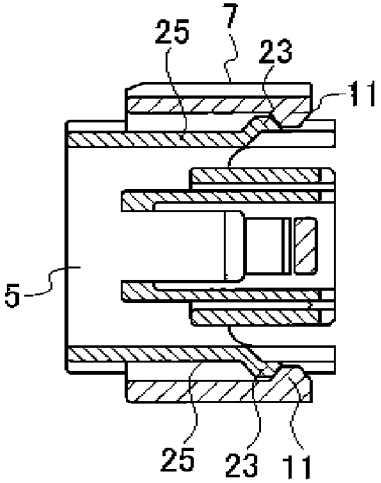
FIG. 3C is a cross sectional view taken along the line IIIC-IIIC in FIG. 3A.

When the lever 7 is positioned in the mated position, the lever 7 which rotates relative to the second connector body portion 35 extends substantially in horizontal (refer to FIGS. 3A to 3C). Further, when the lever 7 is positioned in the predetermined middle position, the lever 7 which rotates relative to the second connector body portion 35 is in a state of being rotated approximately 30 degrees from the mated position (a state where an angle of the lever 7 is high, refer to FIG. 4B), and when the lever 7 is positioned in the separated position, the lever 7 which rotates relative to the second connector body portion 35 is in a state of being rotated approximately 90 degrees from the mated position (a state where an angle of the lever 7 is still higher, refer to FIG. 5B).

The lever 7 is provided with a lever side lock interference portion 43. It is so configured that, when the lever 7 is positioned in the mated position, applying a force to the power supply terminal releasing portion 19 engages the lever side lock interference portion 43 with the power supply terminal locking portion 9 to thereby make it not possible to rotate the lever 7.

Figure 6:
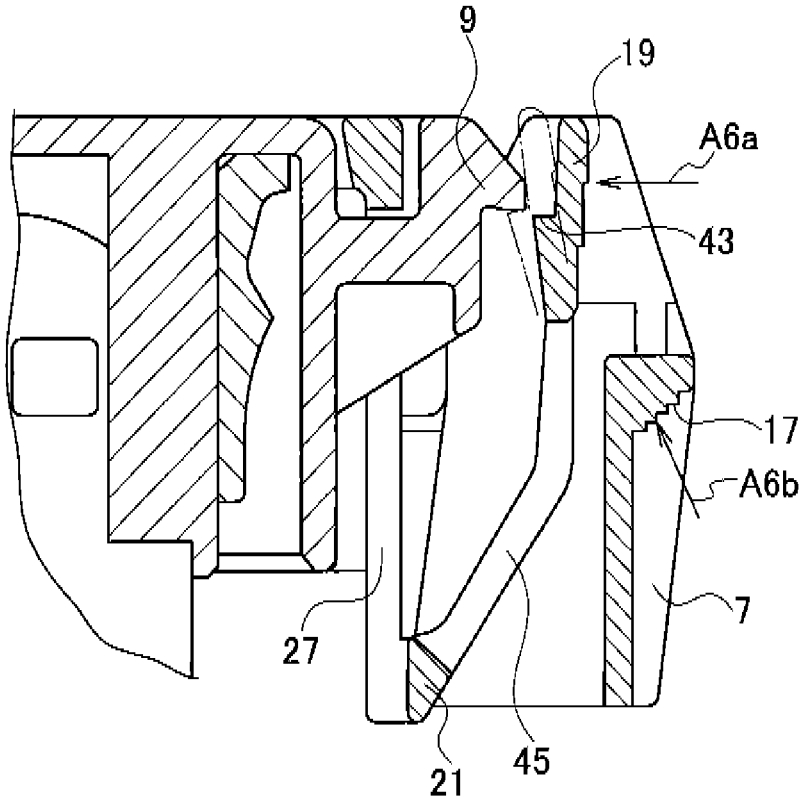
FIG. 6 is an enlarged view of a part VI in FIG. 3B.
Figure 7:
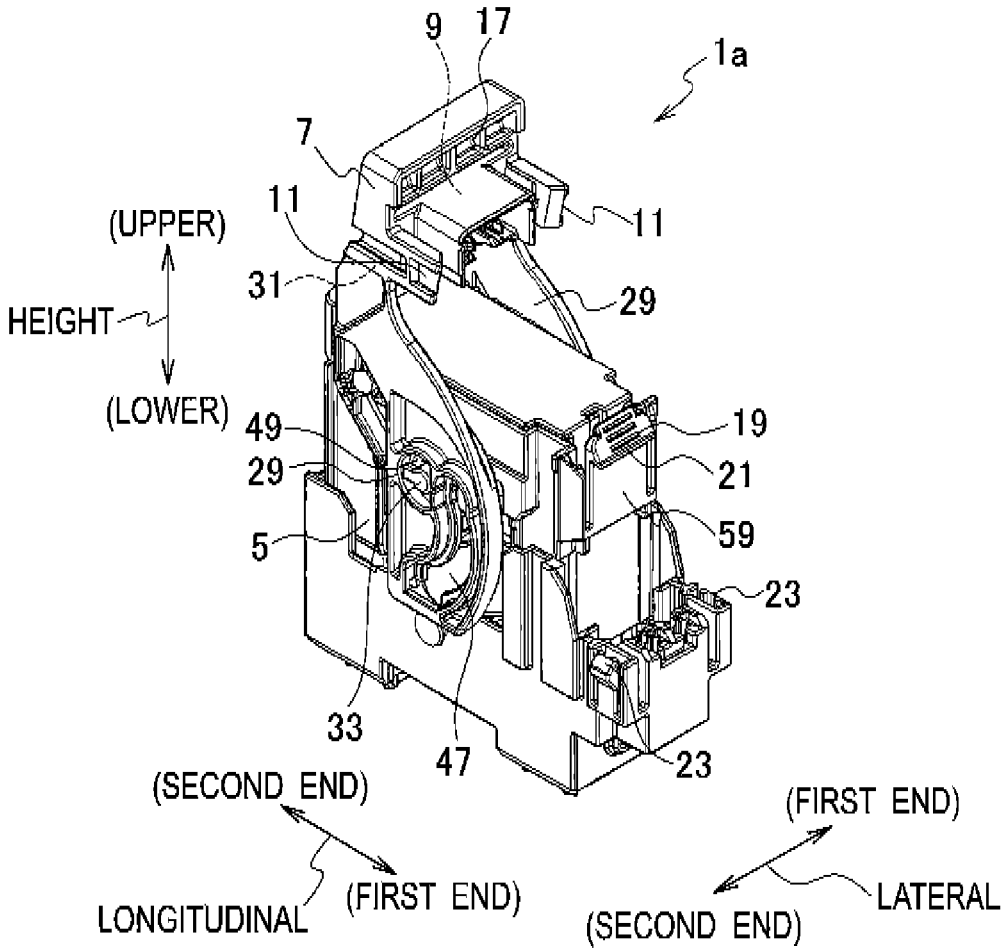
FIG. 7 is a perspective view of a connector engagement body (lever in a separated position) viewed from an upper portion, according to a second embodiment.
Figure 8:
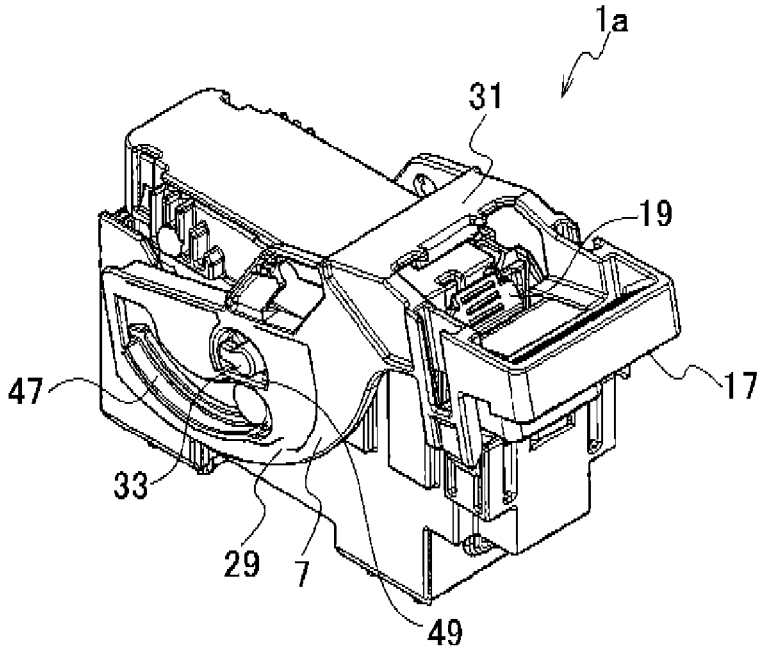
FIG. 8 is a perspective view of the connector engagement body (lever in a predetermined middle position) viewed from an upper portion, according to the second embodiment.
Figure 9:
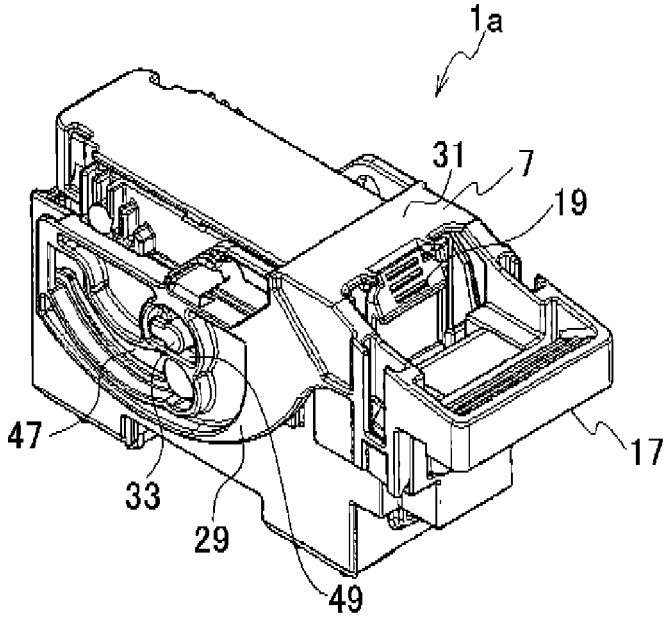
FIG. 9 is a perspective view of the connector engagement body (lever in a mated position) viewed from an upper portion, according to the second embodiment.

That is, when the lever 7 is positioned in the mated position, applying a force toward the power supply terminal releasing portion 19 (a pressing force depicted by an arrow A6*a* in FIG. 6; a force in the direction of allowing the lever side lock interference portion 43 to move toward the power supply terminal locking portion 9 side) elastically deforms, as depicted by a dashed two-dot line in FIG. 6, a distal end side small arm portion 45 provided with the lever side lock interference portion 43 and thereby engages the lever side lock interference portion 43 with the power supply terminal locking portion 9. Accordingly, even when a force (a pressing force depicted by an arrow A6*b* in FIG. 6) is applied to the signal terminal releasing portion 17, the lever 7 is unable to rotate, thus preventing the signal terminal locked portions 23 from being disengaged from the signal terminal locking portions 11.

The connector engagement body 1 will be explained in further detail.

The first connector body portion, second connector body portion 35, cover 37, and lever 7 are each made of, for example, an insulating synthetic resin material similar to the conventional ones. Each of the pair of the arm portions 29 of the lever 7 is provided with a cam groove 47 engageable with the cam pins of the first connector and a rotational spindle engaging hole 49 engageable with the rotational spindle 33.

For convenience of explanation, the height direction is defined as a moving direction of the second connector 5 when the second connector 5 is attached to or detached from the first connector. Further, of the height direction, one direction (the second connector 5 side) is defined as an upper direction while the other direction (the first connector side) is defined as a lower direction. It is so configured that the second connector 5 moves toward the lower direction relative to the first connector to be connected with the first connector and the second connector 5 moves toward the upper direction relative to the first connector to be disengaged from the first connector. Further, one direction perpendicular to the height direction is defined as a longitudinal direction, and one direction perpendicular to the height direction and the longitudinal direction is defined as a lateral direction.

Figure 5A:
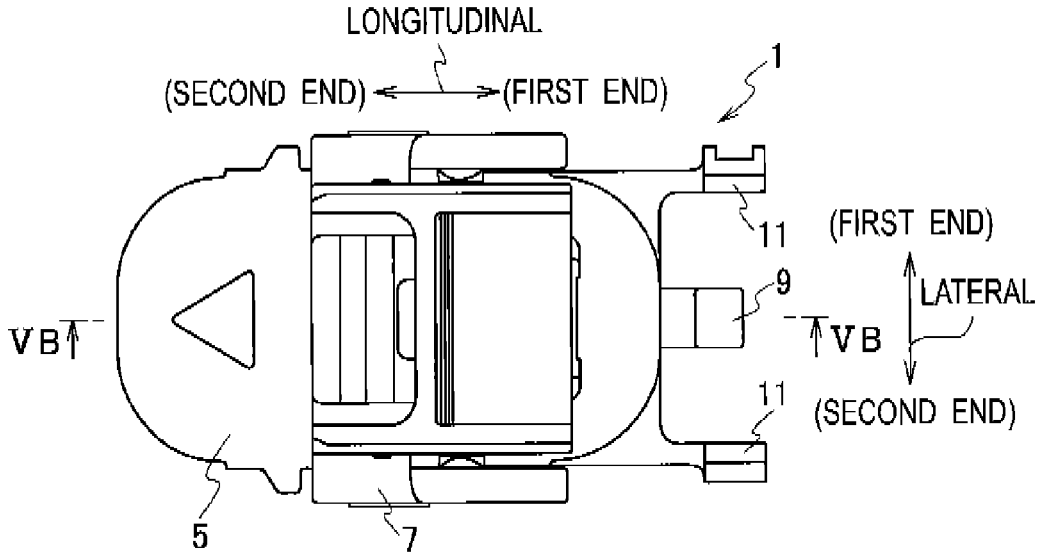
FIG. 5A is a plan view of the connector engagement body (lever in the separated position), according to the first embodiment.
Figure 5B:
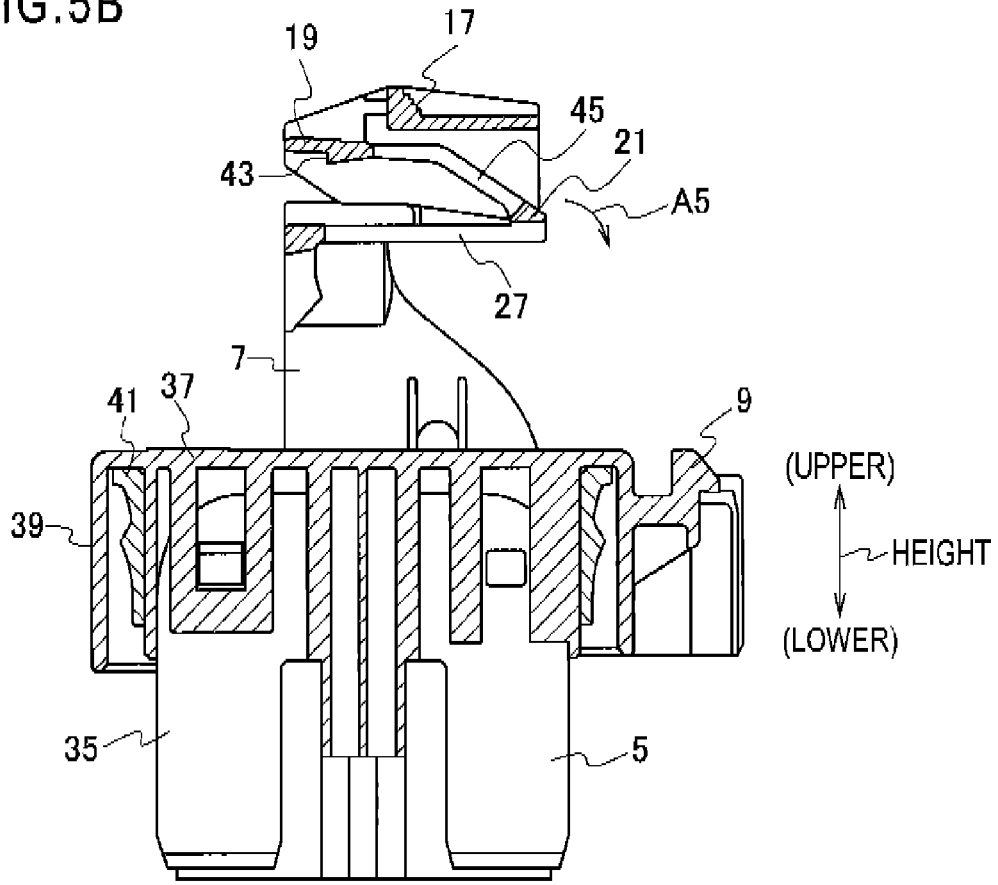
FIG. 5B is a cross sectional view taken along the line VB-VB in FIG. 5A.

It is so configured that the lever 7 is rotated relative to the second connector 5 to thereby change its position. That is, when the lever 7 is positioned in the mated position as illustrated in FIGS. 3A to 3C, the pair of arm portions 29 of the lever 7 extend in the longitudinal direction. Further, when the lever 7 is positioned in the separated position as illustrated in FIGS. 5A and 5B, the pair of arm portions 29 of the lever 7 extend in the height direction. Here, the height direction, longitudinal direction and lateral direction of the lever 7 are principally those observed when the lever 7 is in the mated position as illustrated in FIGS. 3A to 3C.

The power supply terminal locking portion 9 of the second connector 5 protrudes from first end in the longitudinal direction of the cover 37 in the middle of the cover 37 in the lateral direction. It is so configured that the power supply terminal locking portion 9 scarcely deforms elastically.

The pair of signal terminal locking portions 11 of the second connector 5 are provided at respective ends in the lateral direction of the cover 37 and protrude from the first end in the longitudinal direction of the cover 37. It is so configured that the signal terminal locking portions 11 also scarcely deform elastically.

The connecting portion 31 of the lever 7 is provided at the first end (upper side in FIGS. 1, 5A, and 5B) in the longitudinal direction. When the first connector and the second connector 5 are in the mated state (a state in which the lever 7 is positioned in the mated state), as illustrated in FIG. 3A, each of a pair of arm portions 29 of the lever 7 is positioned in one of the respective outer sides of the second connector 5 in the lateral direction, and the connecting portion 31 of the lever 7 is slightly separated from the second connector 5 in the longitudinal direction.

From the connecting portion 31 of the lever 7, the base end side small arm portion 27 and the distal end side small arm portion 45 protrude at the first end in the longitudinal direction. The base end side small arm portion 27 and the distal end side small arm portion 45 each have elasticity. The base end side small arm portion 27 protrudes downward from the connecting portion 31. The distal end side small arm portion 45 upwardly obliquely protrudes from the distal end of the base end side small arm portion 27 toward the first end in the longitudinal direction. Thus, the base end side small arm portion 27 and the distal end side small arm portion 45 form a V-like shape when viewed in the lateral direction.

At the joint portion of the base end side small arm portion 27 and the distal end side small arm portion 45 (the distal end of the base end side small arm portion 27; the base end of the distal end side small arm portion 45), there is provided the power supply terminal locked portion 21 to thereby form an operational lock. The power supply terminal releasing portion 19 and the lever side lock interference portion 43 are formed at the distal end of the distal end side small arm portion 45.

The connecting portion 31 of the lever 7 is provided with a U-like shaped portion 51 having a cross section (a cross section on a plane perpendicular to the height direction in FIG. 3A; a cross section on a plane perpendicular to the longitudinal direction in FIGS. 1, 5A, and 5B) in a form of a U-like shape.

The U-like shaped portion 51 is provided with a pair of side wall portions 53 and a distal end side wall portion 55, and protrudes from the connecting portion 31 of the lever 7 toward the first end in the longitudinal direction (upper side in FIGS. 1, 5A, and 5B, and first end in the longitudinal direction in FIG. 3A) in such a manner as to surround the base end side small arm portion 27 and the distal end side small arm portion 45.

The signal terminal releasing portion 17 is provided at the distal end side wall portion 55, and each of the signal terminal locked portions 23 is provided at a distal end of each of a pair of rod portions 25 protruding upward (the second end in the longitudinal direction in FIG. 1) from each of a pair of side wall portions 53.

Next, operations of the connector engagement body 1 will be explained.

First, in the mated state as illustrated in FIGS. 3A to 3C, a case in which the second connector 5 is separated from the first connector will be explained.

In the state as illustrated in FIGS. 3A to 3C (a state in which the lever 7 is positioned in the mated position), a force depicted by the arrow A3*a* is applied to the signal terminal releasing portion 17 to thereby rotate the lever 7 in the direction depicted by an arrow A3*b*.

According to this rotation, by the change of the engaging positions of the cam grooves 47 at the pair of arm portions 29 of the lever 7 with the cam pins of the first connector, the second connector 5 moves upward. By this rotation, the rod portions 25 elastically deform inward (toward the center side in the lateral direction) to thereby disengage the signal terminal locked portions 23 from the signal terminal locking portions 11. Further rotation of the lever 7 restores the rod portions 25 to thereby separate the second signal terminal 13 of the second connector 5 from the first signal terminal of the first connector.

Figure 4A:
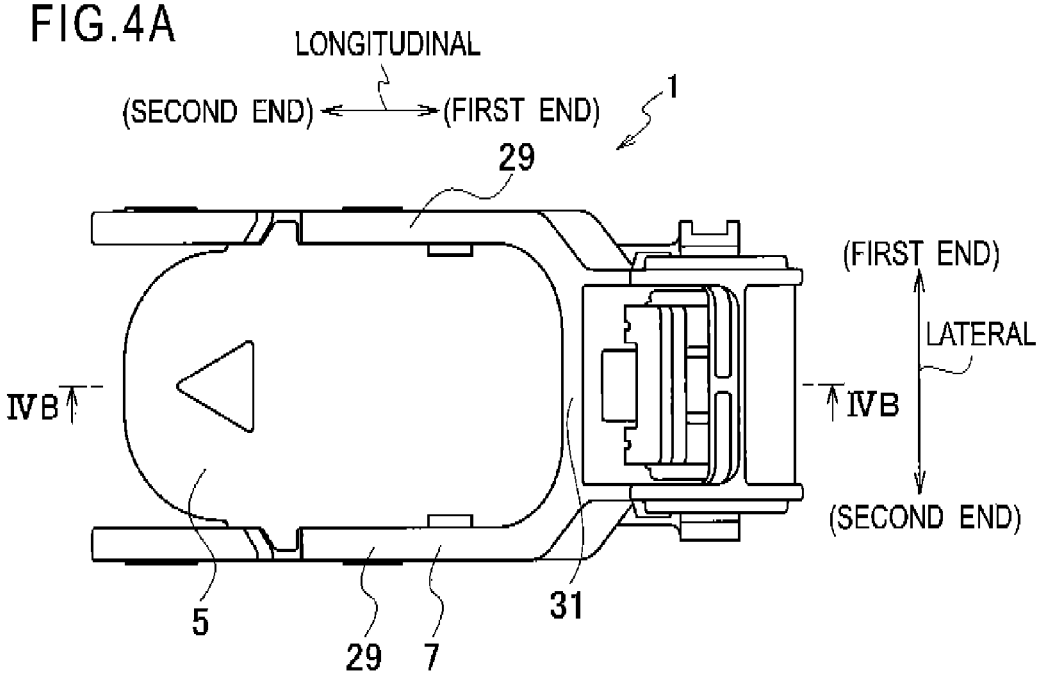
FIG. 4A is a plan view of the connector engagement body (lever in a predetermined middle position), according to the first embodiment.
Figure 4B:
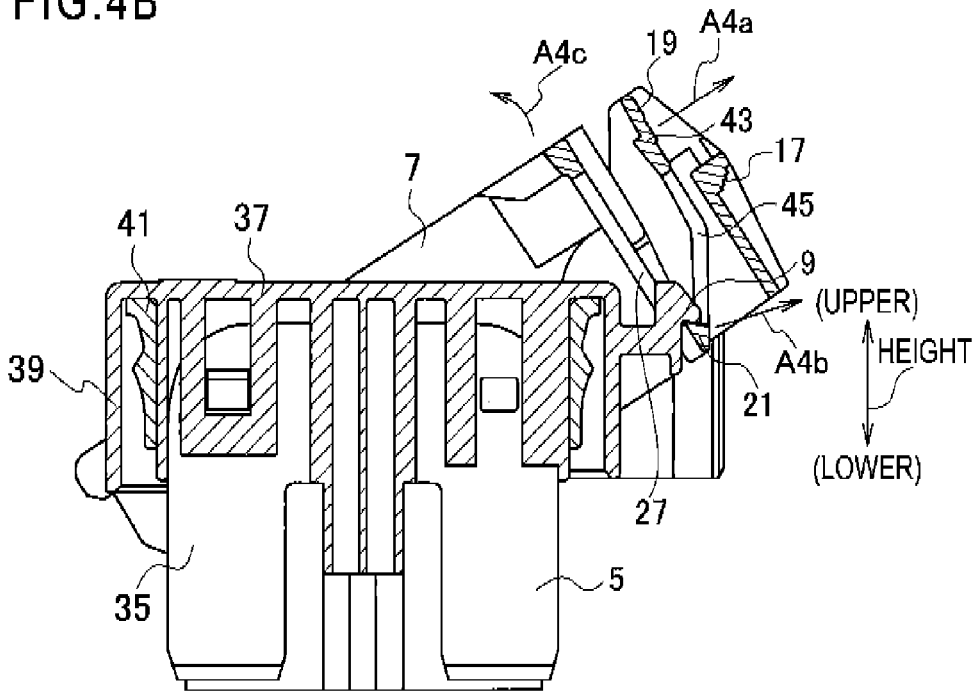
FIG. 4B is a cross sectional view taken along the line IVB-IVB in FIG. 4A.

Further rotation of the lever 7, as illustrated in FIG. 4B, moves the lever 7 to the predetermined middle position to thereby bring it to the predetermined middle state. In the predetermined middle state, the second power supply terminal 15 of the second connector 5 is connected with the first power supply terminal of the first connector. Further, it is so configured that the power supply terminal locked portion 21 abuts the power supply terminal locking portion 9, thus preventing the lever 7 from further rotating to the separated position side (the side depicted by the arrow A4*c*).

In the state as illustrated in FIGS. 4A and 4B, applying a force depicted by the arrow A4*a* to the power supply terminal releasing portion 19 elastically deforms the base end side small arm portion 27 and moves the power supply terminal locked portion 21 in the direction depicted by the arrow A4*b* thereby disengaging the power supply terminal locked portion 21 from the power supply terminal locking portion 9, thus making it possible for the lever 7 to rotate toward the separated position side (side depicted by the arrow A4*c*).

Then, while the force (depicted by the arrow A4*a*) being applied to the power supply terminal releasing portion 19, applying a force to the signal terminal releasing portion 17 of the lever 7 to thereby rotate the lever 7 toward the side depicted by the arrow A4*c* rotates the lever 7, gradually moves the second connector 5 upward and gradually separates the second connector 5 from the first connector, thereby separating the second power supply terminal 15 of the second connector 5 from the first power supply terminal of the first connector. Further rotation of the lever 7 brings it to the separated state as illustrated in FIGS. 5A and 5B.

Note that, in order to move from the separated state as illustrated in FIGS. 5A and 5B to the mated state as illustrated in FIGS. 3A to 3C, it is sufficient to merely rotate the lever 7 toward the side depicted by the arrow A5 in FIG. 5B, without the need of applying another force to the power supply terminal releasing portion 19 and the like.

According to the connector engagement body 1, when the lever 7 is positioned in the mated position, applying the force to the signal terminal releasing portion 17 disengages the signal terminal locked portions 23 from the signal terminal locking portions 11 thereby making the lever 7 rotatable to the predetermined middle position, which brings only the first and second signal terminals to be broken with this rotation. Then, it is so configured that, when the lever 7 is positioned in the predetermined middle position, applying the force to the power supply terminal releasing portion 19 disengages the power supply terminal locked portion 21 from the power supply terminal locking portion 9 thereby making the lever 7 rotatable to the separated position, which brings the first and second power supply terminals to be broken with this rotation. Thus, it is so made that a clear time difference exists between breaking of the signal circuit and the breaking of the power supply circuit (main circuit). Thus, occurrence of arc which may be caused when the signal circuit or main circuit is broken can be prevented.

Further, according to the connector engagement body 1, despite the structure of accomplishing waterproof of the first and second signal terminals and the first and second power supply terminals, it is so configured that the power supply terminal locking can be applied at a high angle position of the lever 7 thus making it possible to achieve a two-step locking structure. That is, the waterproof structure of the terminals of the signal circuit and the terminals of the power supply circuit is maintained even in the state that the lever 7 is positioned between the mated position and the separated side position or in the state that the lever 7 is positioned between the mated position and the position in the neighborhood of the separated side position (even when the rotational angle of the lever 7 becomes high due to the rotation of the lever 7). Then, it is so configured that the first-step locking by the signal terminal locked portions 23 and signal terminal locking portions 11 and the second-step locking by the power supply terminal locked portion 21 and power supply terminal locking portion 9 are accomplished.

Further, according to the connector engagement body 1, it is so configured that, with the lever 7 positioned in the mated position, applying the force to the power supply terminal releasing portion 19 engages the lever side lock interference portion 43 with the power supply terminal locking portion 9, thus making it not possible to rotate the lever 7. Thus, the lever 7 can be prevented from rotating to the separated position side due to an erroneous operation, thereby preventing an event that the connecting state of the first and second signal terminals are broken.

Second Embodiment

Referring to FIGS. 7 to 12, a second embodiment of the present invention will be explained.

A connector engagement body 1*a* according to the second embodiment is different from the connector engagement body 1 according to the first embodiment in that the connector engagement body 1*a* has such a structure that the power supply terminal releasing portion 19, the power supply terminal locked portion 21 and the signal terminal locked portions 23 are included in the second connector 5; the signal terminal releasing portion 17, the power supply terminal locking portion 9 and the signal terminal locking portions 11 are included in the lever 7; and further a movable lock stopper 57 is included in the lever 7. Other portions of the connector engagement body 1*a* according to the second embodiment are substantially the same in structure as those of the connector engagement body 1 according to the first embodiment, achieving an effect substantially the same as that brought about by the connector engagement body 1.

That is, the connector engagement body 1*a* according to the second embodiment includes, as illustrated in FIGS. 7 to 12, the first connector (not illustrated), the second connector 5, and the lever 7.

The first connector includes the first signal terminal and the first power supply terminal.

The second connector 5 includes the power supply terminal releasing portion 19, the power supply terminal locked portion 21, the signal terminal locked portions 23, the second signal terminal 13 which is adapted to be connected with the first signal terminal of the first connector when the second connector 5 is mated with the first connector, and the second power supply terminal 15 which is adapted to be connected with the first power supply terminal of the first connector when the second connector 5 is mated with the first connector.

The lever 7 includes the signal terminal releasing portion 17, the power supply terminal locking portion 9 to which the power supply terminal locked portion 21 of the second connector 5 is locked, and the signal terminal locking portions 11 to which the signal terminal locked portions 23 of the second connector 5 are locked.

The lever 7 engages with the first connector and the second connector 5, and causes the mating force and the separating force to act between the first connector and the second connector 5 by moving between the mated position (refer to FIGS. 10A to 10C) and the separated position (refer to FIGS. 12A and 12B) relative to the first connector and the second connector 5.

When the lever 7 is positioned in the mated position, the signal terminal locked portions 23 are locked to the signal terminal locking portions 11, to thereby allow the first and second signal terminals to be connected with each other and the first and second power supply terminals to be connected with each other.

When the lever 7 is positioned in the predetermined middle position (refer to FIGS. 11A and 11B) between the mated position and the separated position, the first and second power supply terminals are connected with each other and the first and second signal terminals are separated from each other.

When the lever 7 is positioned in the separated position, the first and second power supply terminals are separated from each other and the first and second signal terminals are also separated from each other.

When the lever 7 is positioned in the mated position, applying a force to the signal terminal releasing portion 17 disengages the signal terminal locked portions 23 from the signal terminal locking portions 11 to thereby make the lever 7 rotatable to the predetermined middle position.

When the lever 7 is positioned in the predetermined middle position, applying a force to the power supply terminal releasing portion 19 disengages the power supply terminal locked portion 21 from the power supply terminal locking portion 9 to thereby make the lever 7 rotatable to the separated position.

Figure 10A:
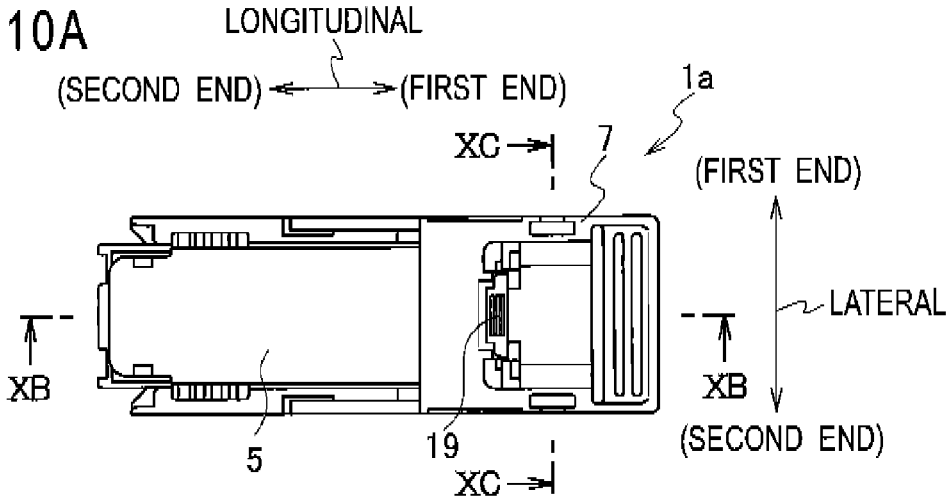
FIG. 10A is a plan view of the connector engagement body (lever in the mated position), according to the second embodiment.
Figure 10B:
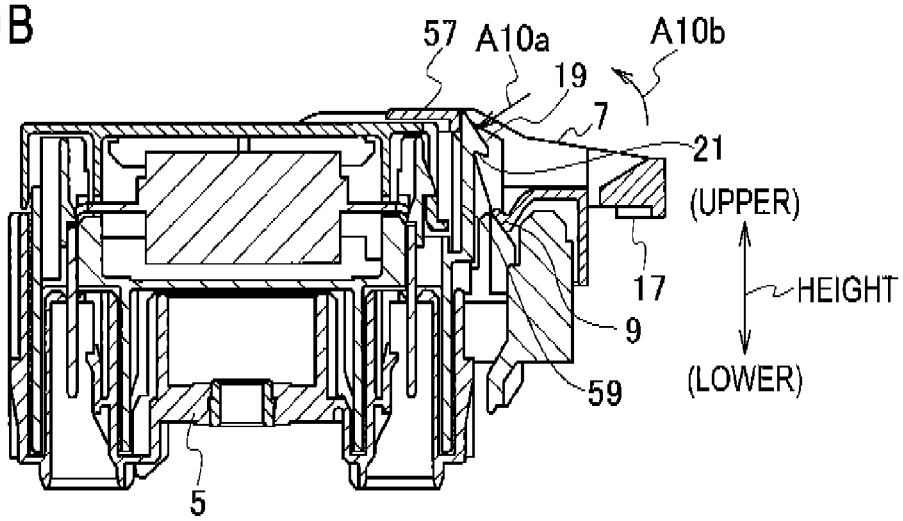
FIG. 10B is a cross sectional view taken along the line XB-XB in FIG. 10A.

The movable lock stopper 57 is included in the lever 7 (refer to FIG. 10B). And it is so configured that, when the lever 7 is positioned in the mated position, even if a force (a force depicted by an arrow A10*a* as illustrated in FIG. 10B) is applied to the power supply terminal releasing portion 19, the power supply terminal locked portion 21 is unable to move (not possible to move) due to the power supply terminal releasing portion 19 abutting the movable lock stopper 57.

The power supply terminal locking portion 9 of the lever 7 is provided in the middle portion of the connecting portion 31. The pair of signal terminal locking portions 11 of the lever 7 are provided at respective end portions of the connecting portion 31. Note that, it is so made that the power supply terminal locking portion 9 and the signal terminal locking portions 11 both scarcely make an elastic deformation. On an opposite side from the arm portion 29, the signal terminal releasing portion 17 of the lever 7 is provided to protrude from the connecting portion 31.

The power supply terminal releasing portion 19 and power supply terminal locked portion 21 of the second connector 5 are formed at a distal end of a rod portion (arm portion; flat plate beam portion) 59 having an elasticity. The rod portion 59 protrudes upward from the predetermined portion (upper side and first end in the longitudinal direction) of the second connector 5.

Each of the signal terminal locked portions 23 of the second connector 5 is formed at a distal end of one of a pair of rod portions 25 having an elasticity. Each of the rod portions 25 protrudes upward from the predetermined portion (first end in the longitudinal direction at the lower side and respective end portions in the lateral direction) of the second connector 5.

Next, operations of the connector engagement body 1*a* will be explained.

First, in the mated state in FIGS. 10A to 10C, a case in which the second connector 5 is separated from the first connector will be explained.

Figure 10C:
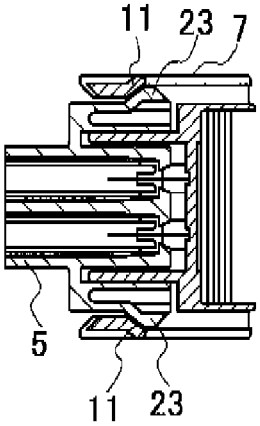
FIG. 10C is a cross sectional view taken along the line XC-XC in FIG. 10A.

In the state as illustrated in FIGS. 10A to 10C (a state in which the lever 7 is positioned in the mated position), a force is applied to the signal terminal releasing portion 17 to thereby rotate the lever 7 in the direction depicted by an arrow A10*b* in FIG. 10B.

According to this rotation, the second connector 5 moves upward. Further, by the above rotation, the rod portions 25 elastically deform toward the middle in the lateral direction to thereby disengage the signal terminal locked portions 23 from the signal terminal locking portions 11. Further rotation of the lever 7 separates the second signal terminal 13 of the second connector 5 from the first signal terminal of the firs connector.

Figure 11A:
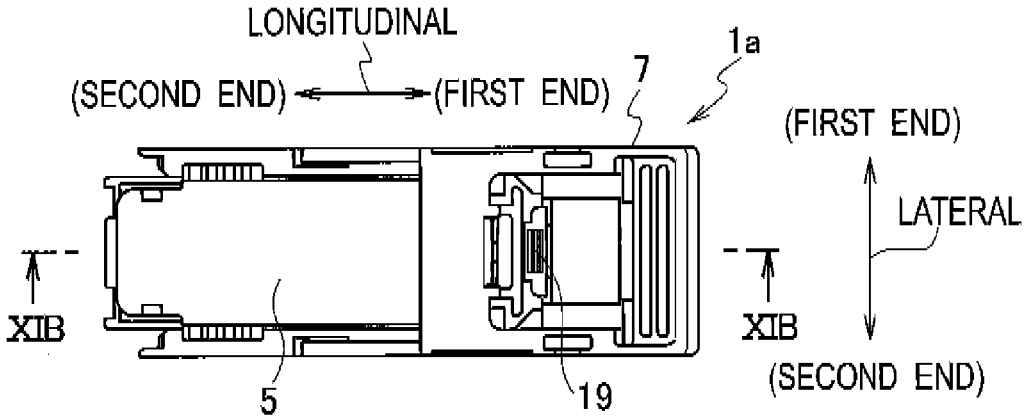
FIG. 11A is a plan view of the connector engagement body (lever in the predetermined middle position), according to the second embodiment.
Figure 11B:
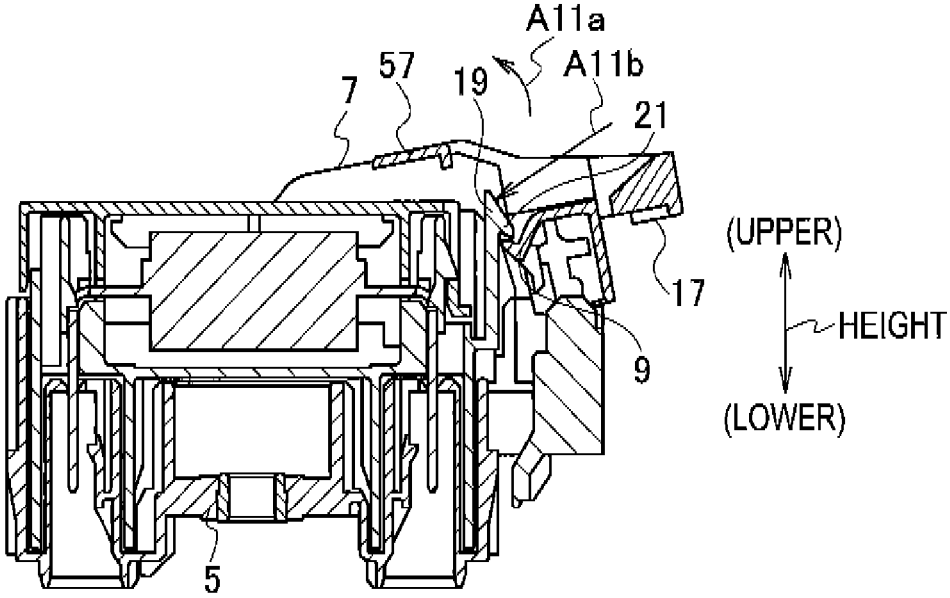
FIG. 11B is a cross sectional view taken along the line XIB-XIB in FIG. 11A.

Still further rotation of the lever 7, as illustrated in FIGS. 11A and 11B, brings about the predetermined middle state with the lever 7 positioned in the predetermined middle position. In the predetermined middle state, the second power supply terminal 15 of the second connector 5 is connected with the first power supply terminal of the first connector. Further, it is so configured that, with the power supply terminal locked portion 21 abutting the power supply terminal locking portion 9, the lever 7 cannot rotate any further toward the separated position side (the side depicted by an arrow A11*a*).

In the state as illustrated in FIGS. 11A and 11B, applying a force depicted by an arrow A11*b* to the power supply terminal releasing portion 19 elastically deforms the rod portion 59 thereby disengaging the power supply terminal locked portion 21 from the power supply terminal locking portion 9, thus making it possible for the lever 7 to rotate toward the separated position side (the side depicted by the arrow A11*a*).

Then, with the force (depicted by the arrow A11*b*) being applied to the power supply terminal releasing portion 19, applying the force to the lever 7 to thereby rotate the lever 7 to the side depicted by the arrow A11*a* rotates the lever 7 and gradually moves the second connector 5 upward and thereby gradually moves the second connector 5 away from the first connector, which separates the second power supply terminal 15 of the second connector 5 from the first power supply terminal of the first connector. Further rotation of the lever 7 brings about the separated state as illustrated in FIGS. 12A and 12B.

Figure 12A:
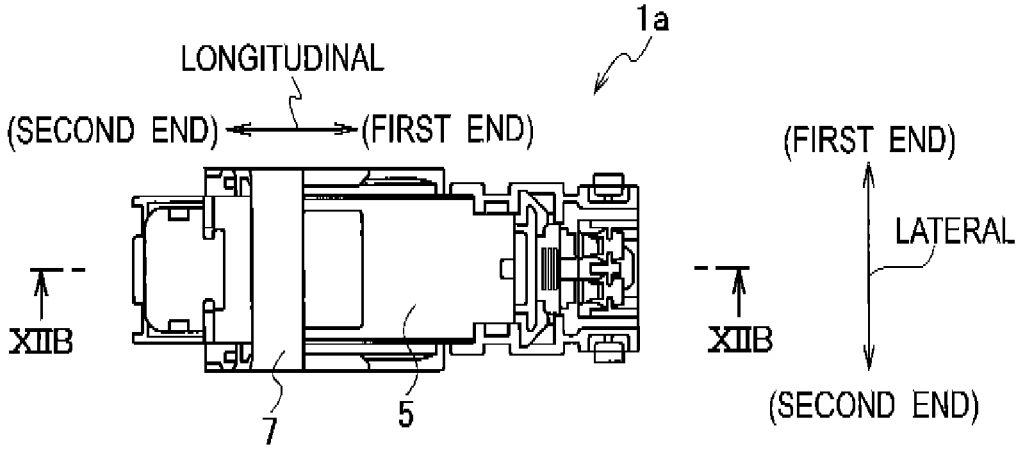
FIG. 12A is a plan view of the connector engagement body (lever in the separated position), according to the second embodiment.
Figure 12B:
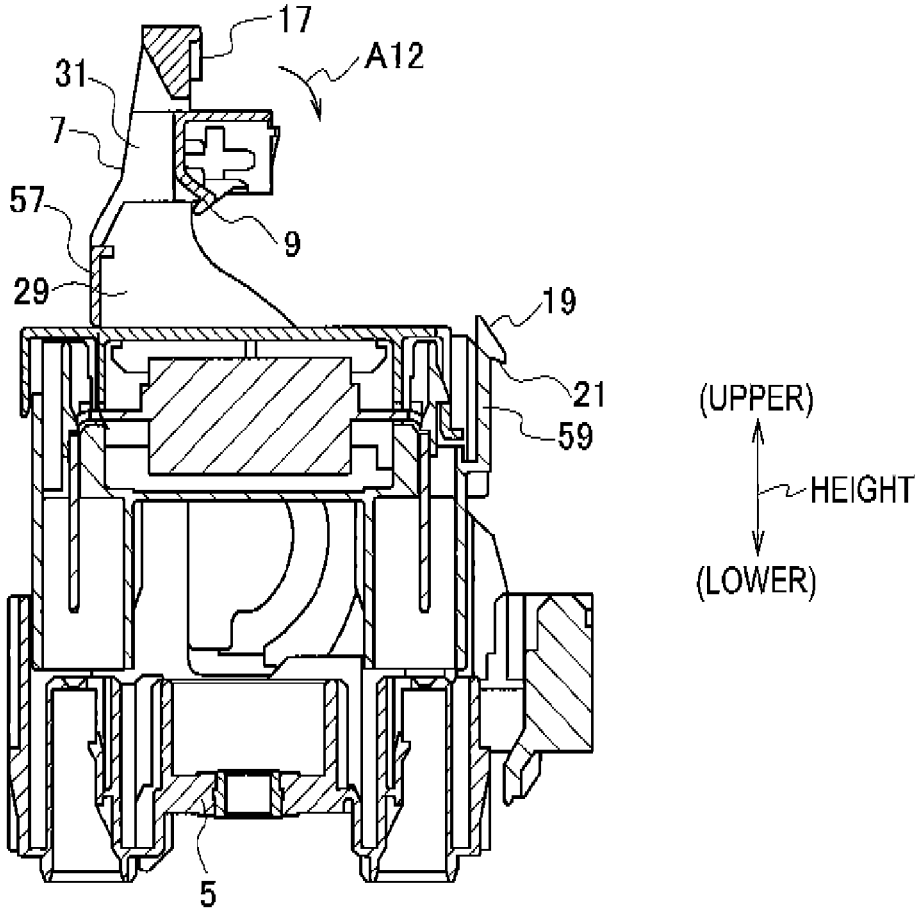
FIG. 12B is a cross sectional view taken along the line XIIB-XIIB in FIG. 12A.
Figure 13:
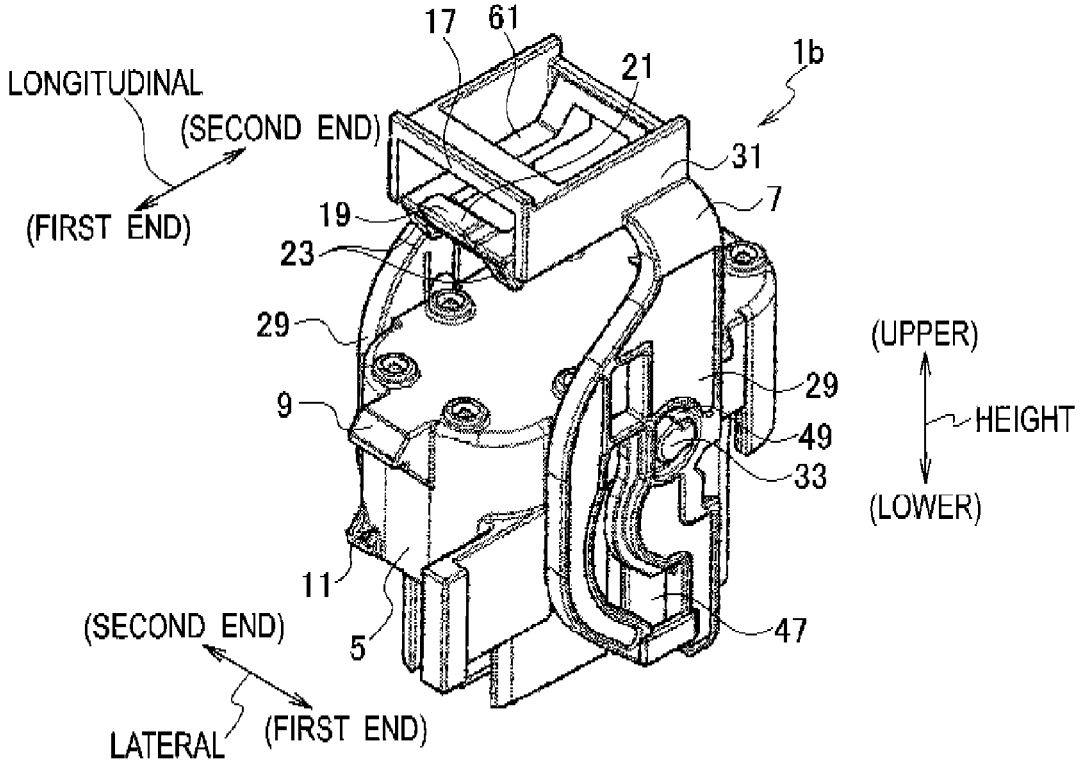
FIG. 13 is a perspective view of a connector engagement body (lever in a separated position) viewed from an upper portion, according to a third embodiment.
Figure 14:
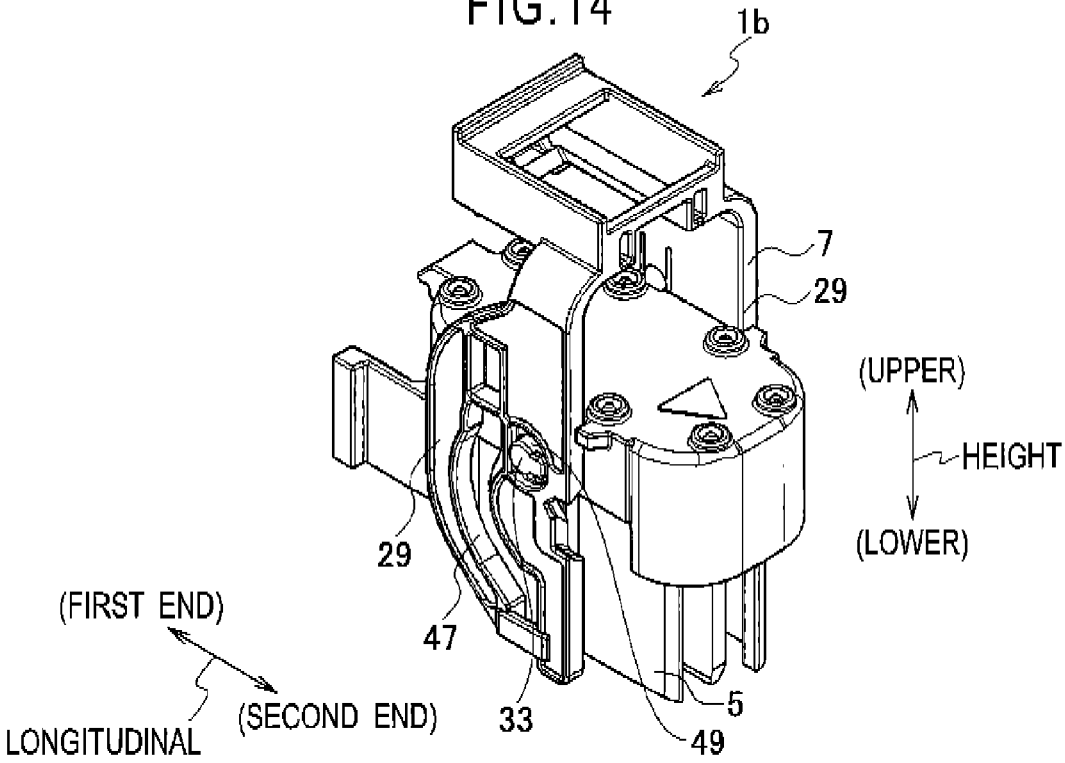
FIG. 14 is a perspective view of the connector engagement body (lever in the separated position) viewed from an upper portion (another upper position different from that in FIG. 13), according to the third embodiment.
Figure 15A:
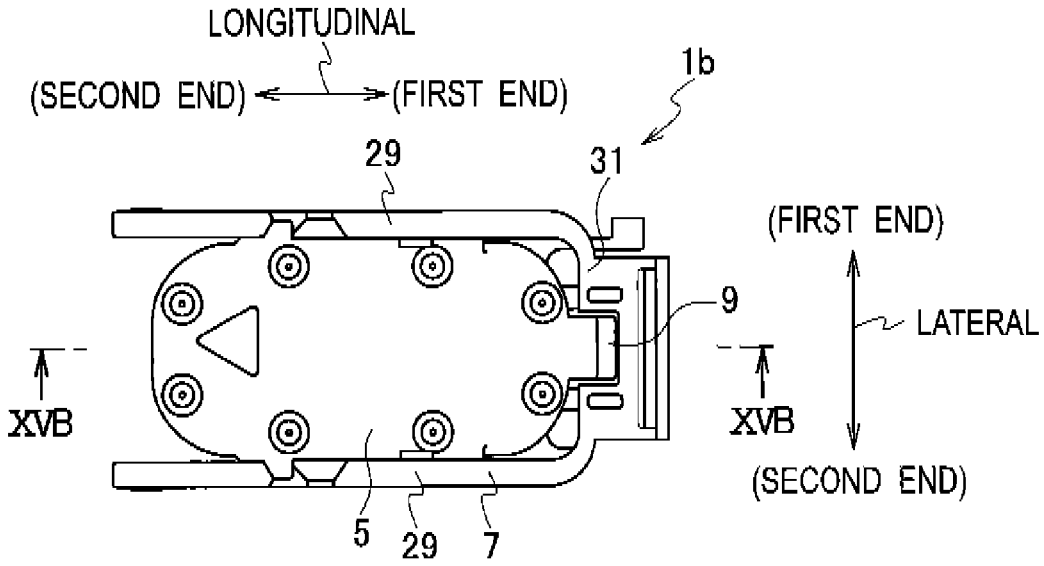
FIG. 15A is a plan view of the connector engagement body (lever in a mated position), according to the third embodiment.
Figure 15B:
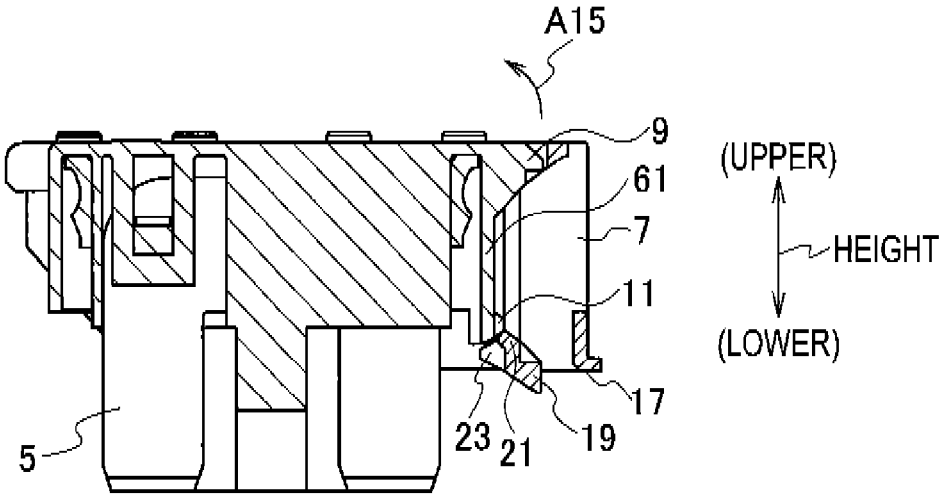
FIG. 15B is a cross sectional view taken along the line XVB-XVB in FIG. 15A.

Note that, in order to move from the separated state as illustrated in FIGS. 12A and 12B to the mated state as illustrated in FIGS. 10A to 10C, it is sufficient to merely rotate the lever 7 toward the side depicted by an arrow A12 in FIG. 12B.

Third Embodiment

Referring to FIGS. 13 to 17, a third embodiment of the present invention will be explained.

A connector engagement body 1*b* according to the third embodiment is different from the connector engagement body 1 according to the first embodiment in that the connector engagement body 1*b* has such a structure that the signal terminal locked portions 23, the power supply terminal locked portion 21, and the power supply terminal releasing portion 19 are formed at the distal end portion of an elastic portion 61 extending out from the lever 7. Other portions of the connector engagement body 1*b* according to the third embodiment are substantially the same in structure as those of the connector engagement body 1 according to the first embodiment, achieving an effect substantially the same as that brought about by the connector engagement body 1.

Figure 16A:
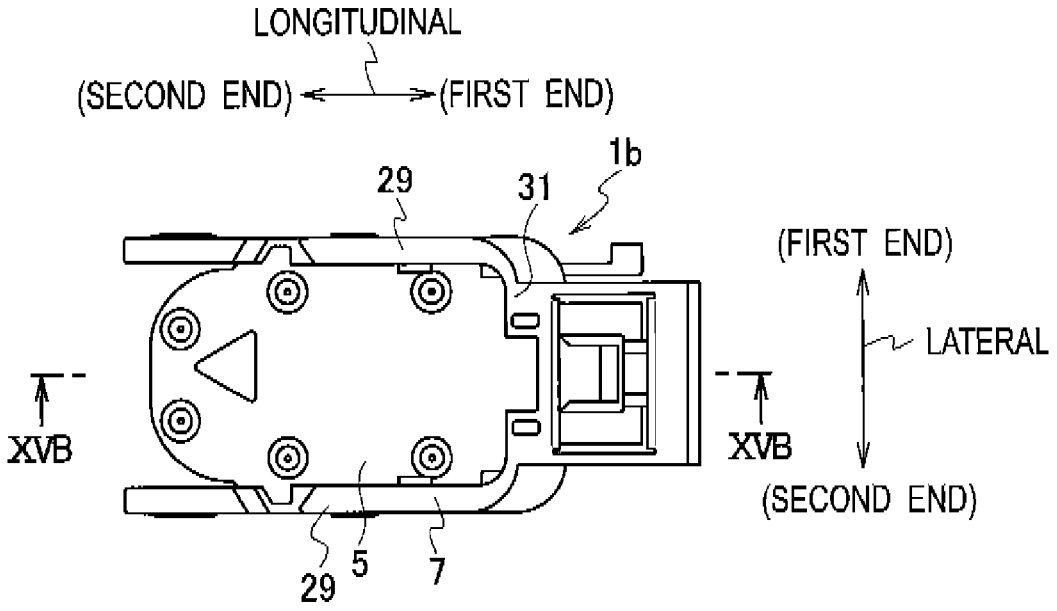
FIG. 16A is a plan view of the connector engagement body (lever in a predetermined middle position), according to the third embodiment.
Figure 16B:
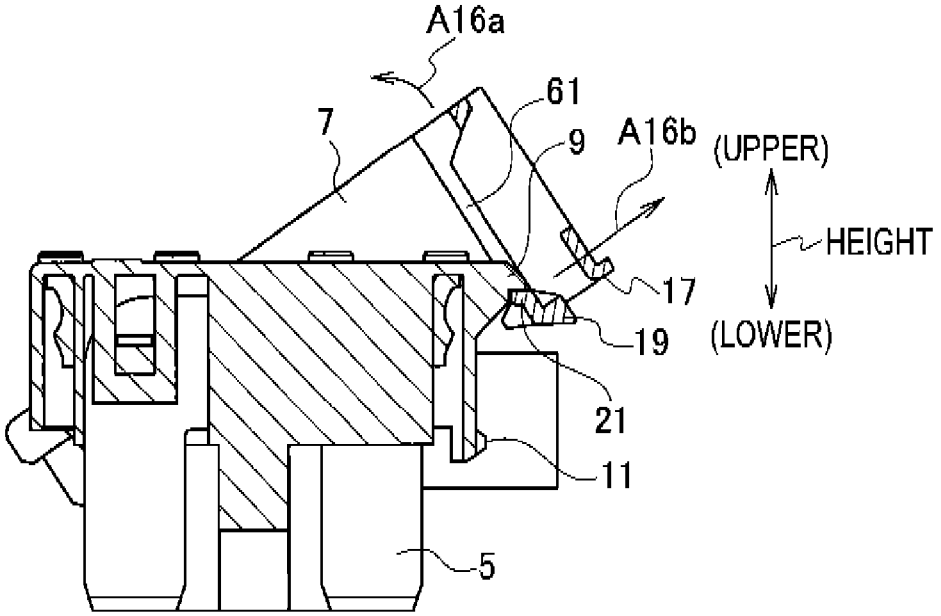
FIG. 16B is a cross sectional view taken along the line XVIB-XVIB in FIG. 16A.
Figure 17A:
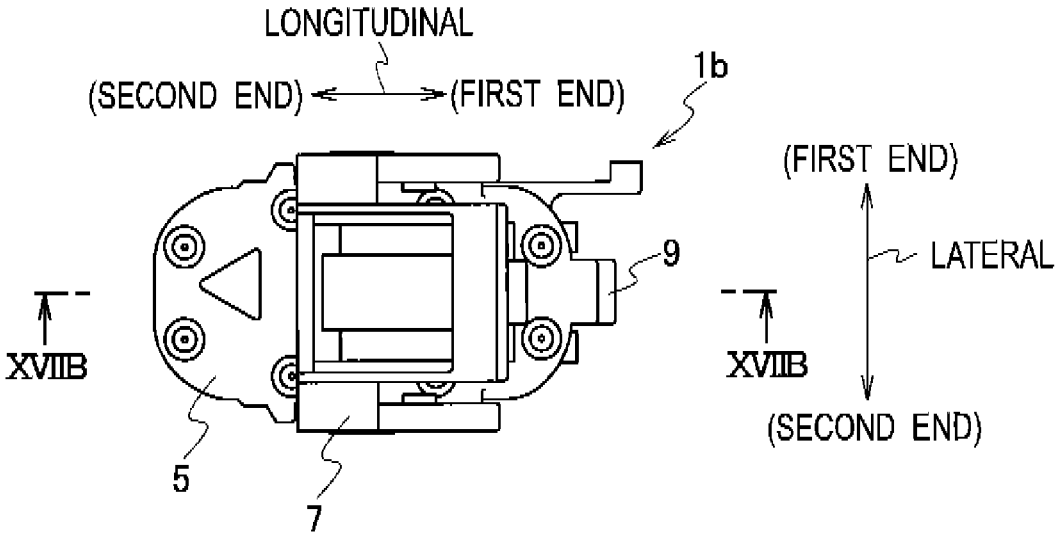
FIG. 17A is a plan view of the connector engagement body (lever in a separated position), according to the third embodiment.
Figure 17B:
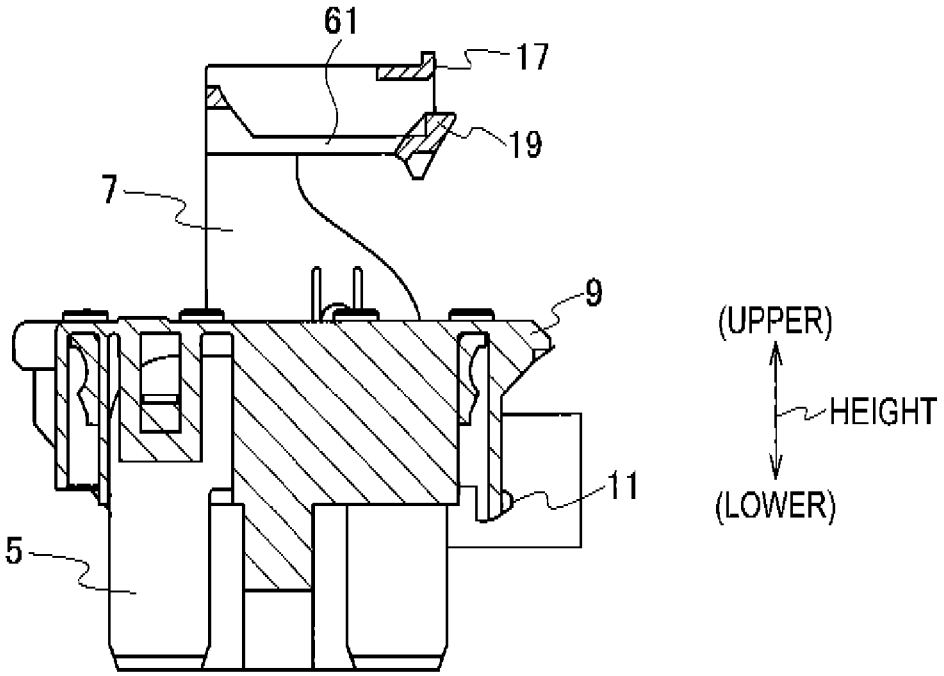
FIG. 17B is a cross sectional view taken along the line XVIIB-XVIIB in FIG. 17A.
Figure 18:
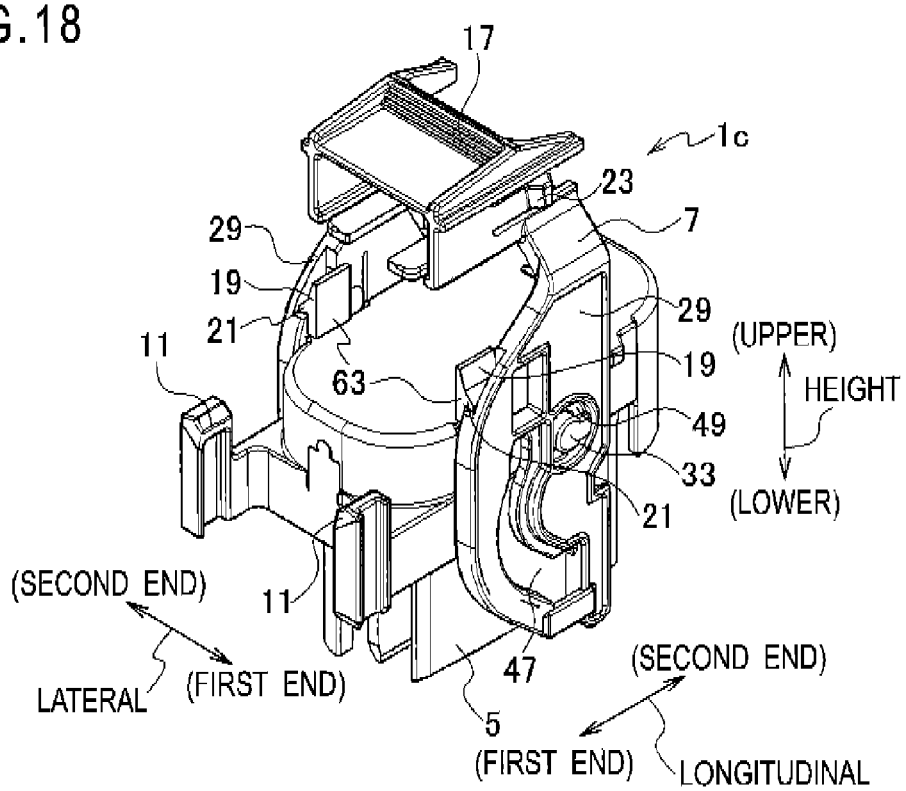
FIG. 18 is a perspective view of a connector engagement body (lever in a separated position) viewed from an upper portion, according to a fourth embodiment.
Figure 19:
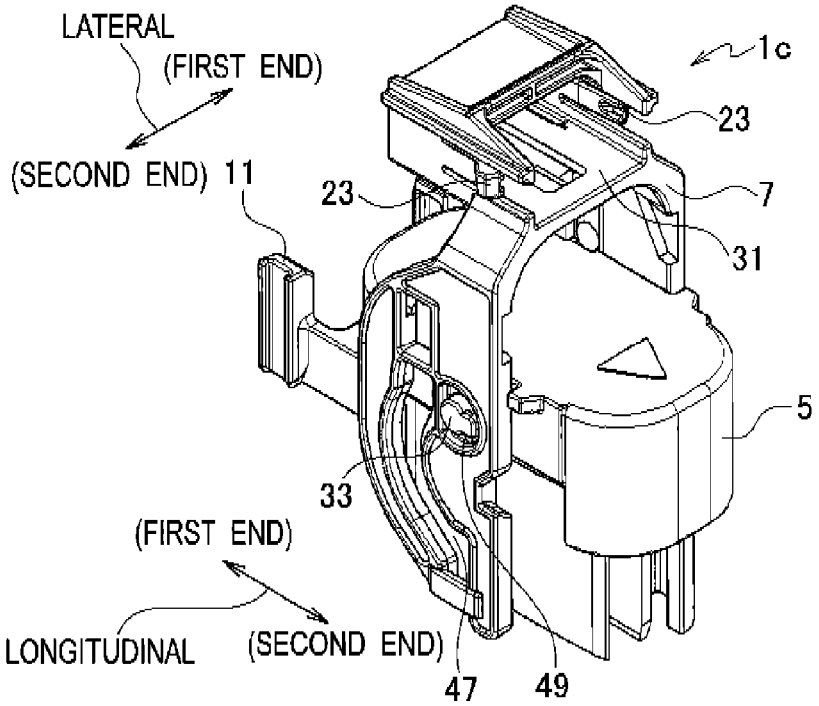
FIG. 19 is a perspective view of the connector engagement body (lever in the separated position) viewed from an upper portion (anther upper position different from that in FIG. 18), according to the fourth embodiment.

According to the connector engagement body 1*b*, as illustrated in FIGS. 13 to 17, it is so configured that, with the state in which the lever 7 is positioned in the mated position (refer to FIGS. 15A and 15B), rotating the lever 7 toward the predetermined middle position side (a side depicted by an arrow A15 in FIG. 15B) by applying a force to the signal terminal releasing portion 17 elastically deforms the elastic portion 61 to thereby disengage the signal terminal locked portions 23 from the signal terminal locking portions 11, and the elastic portion 61 is then restored and the lever 7 rotates to the predetermined middle position (refer to FIGS. 16A and 16B).

It is so configured that, when the lever 7 rotates to the predetermined middle position, the power supply terminal locked portion 21 is locked to the power supply terminal locking portion 9, thus making it not possible for the lever 7 to rotate (unrotatable) from the predetermined middle position toward the separated position side (the side depicted by an arrow A16*a* in FIG. 16B).

Further, it is so configured that, when the lever 7 rotates to the predetermined middle position thereby locking the power supply terminal locked portion 21 to the power supply terminal locking portion 9, applying a force (a force depicted by an arrow A16*b* in FIG. 16B) to the power supply terminal releasing portion 19 to thereby elastically deform the elastic portion 61 disengages the power supply terminal locked portion 21 from the power supply terminal locking portion 9, which makes it possible for the lever 7 to rotate from the middle position to the separated position (toward the side depicted by an arrow A16*a* in FIG. 16B).

Note that, the connector engagement body lb has such a structure that the pair of signal terminal locking portions 11 and the pair of signal terminal locked portions 23 are provided at respective end portions in the lateral direction, and the power supply terminal locked portion 21 and the power supply terminal locking portions 9 are provided at the center portion in the lateral direction.

Fourth Embodiment

Referring to FIGS. 18 to 22, a fourth embodiment of the present invention will be explained.

A connector engagement body 1*c* according to the fourth embodiment is different from the connector engagement body 1 according to the first embodiment in that the connector engagement body 1*c* has such a structure that the signal terminal locking portions 11, power supply terminal locked portions 21, and power supply terminal releasing portions 19 are included in the second connector 5; and the signal terminal releasing portion 17, power supply terminal locking portions 9, and the signal terminal locked portions 23 are included in the lever 7. Other portions of the connector engagement body 1*c* according to the fourth embodiment are substantially the same in structure as those of the connector engagement body 1 according to the first embodiment, achieving an effect substantially the same as that brought about by the connector engagement body 1.

That is, the connector engagement body 1*c* according to the fourth embodiment includes, as illustrated in FIGS. 18 to 22, the first connector (not illustrated) provided with the first signal terminal and first power supply terminal, the second connector 5, and the lever 7.

The second connector 5 includes the signal terminal locking portions 11, the power supply terminal locked portions 21, the power supply terminal releasing portions 19, the second signal terminal 13 adapted to be connected with the first signal terminal of the first connector when the second connector 5 is mated with the first connector, and the second power supply terminal 15 adapted to be connected with the first power supply terminal of the first connector when the second connector 5 is mated with the first connector.

The lever 7 includes the signal terminal releasing portion 17, the power supply terminal locking portions 9 to which the power supply terminal locked portions 21 of the second connector 5 are locked, and the signal terminal locked portions 23 configured to be locked to the signal terminal locking portions 11 of the second connector 5.

The lever 7 engages with the first connector and the second connector 5, and causes the mating force and the separating force to act between the first connector and the second connector 5 by moving between the mated position (refer to FIGS. 20A and 20B) and the separated position (refer to FIGS. 22A and 22B) relative to the first connector and the second connector 5.

When the lever 7 is positioned in the mated position, the signal terminal locked portions 23 is locked to the signal terminal locking portions 11, allowing the first and second signal terminals to be connected with each other and the first and second power supply terminals to be connected with each other.

When the lever 7 is positioned in the predetermined middle position (refer to FIGS. 21A and 21B) between the mated position and the separated position, the first and second power supply terminals are connected with each other and the first and second signal terminals are separated from each other.

When the lever 7 is positioned in the separated position, the first and second power supply terminals are separated from each other and the first and second signal terminals are separated from each other.

When the lever 7 is positioned in the mated position, applying a force to the signal terminal releasing portion 17 disengages the signal terminal locked portions 23 from the signal terminal locking portions 11 to thereby make the lever 7 rotatable to the predetermined middle position.

When the lever 7 is positioned in the predetermined middle position, applying a force to the power supply terminal releasing portions 19 disengages the power supply terminal locked portions 21 from the power supply terminal locking portions 9 to thereby make the lever 7 rotatable to the separated position.

The connector engagement body 1*c* has such a structure that each of the power supply terminal locking portions 9 is formed at one of a pair of arm portions 29. Further, the connector engagement body 1*c* has such a structure that the power supply terminal releasing portions 19 and the power supply terminal locking portions 9 are formed at the respective distal ends of arm portions 63 of the second connector 5.

The pair of arm portions 63 of the second connector 5 protrude upward from respective predetermined portions (portions on the first end in the longitudinal direction at the upper side at both ends M the lateral direction) of the second connector 5.

It is so configured, that when the second connector 5 is mated with the first connector or when the second connector 5 is separated from the first connector, the arm portions 63 of the second connector 5 are caused to make elastic deformations.

Figure 20A:
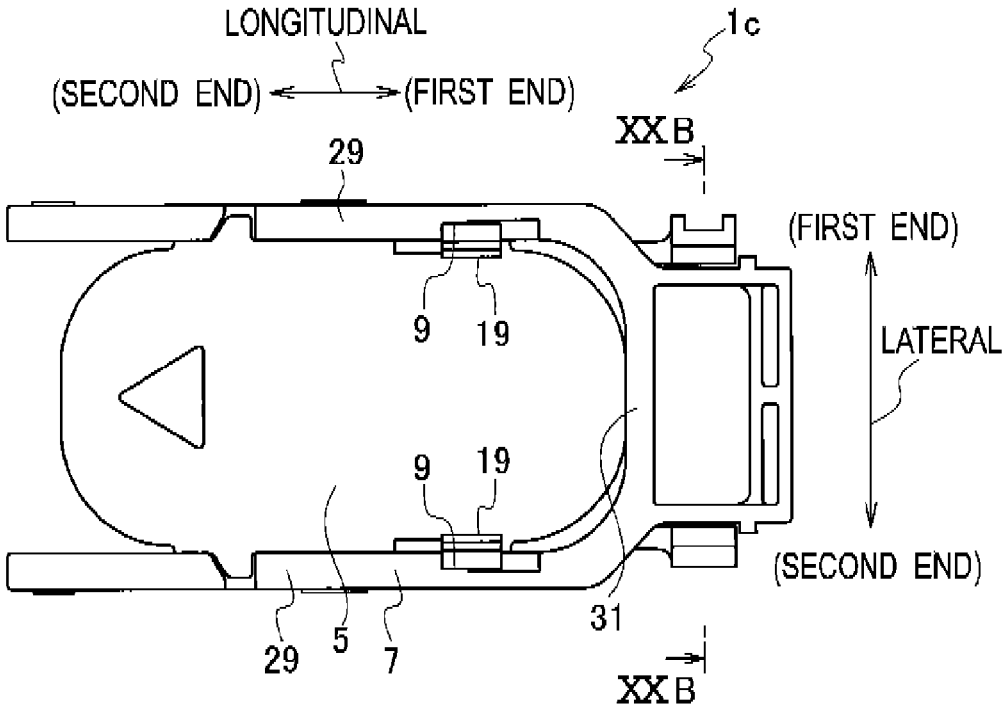
FIG. 20A is a plan view of the connector engagement body (lever in a mated position), according to the fourth embodiment.
Figure 20B:
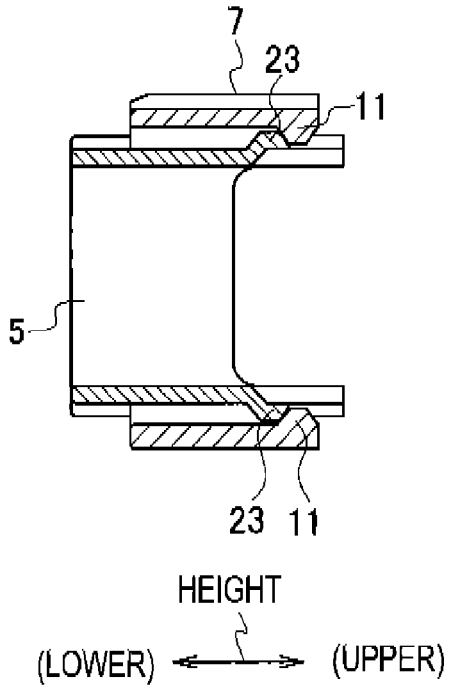
FIG. 20B is a cross sectional view taken along the line XXB-XXB in FIG. 20A.
Figure 21A:
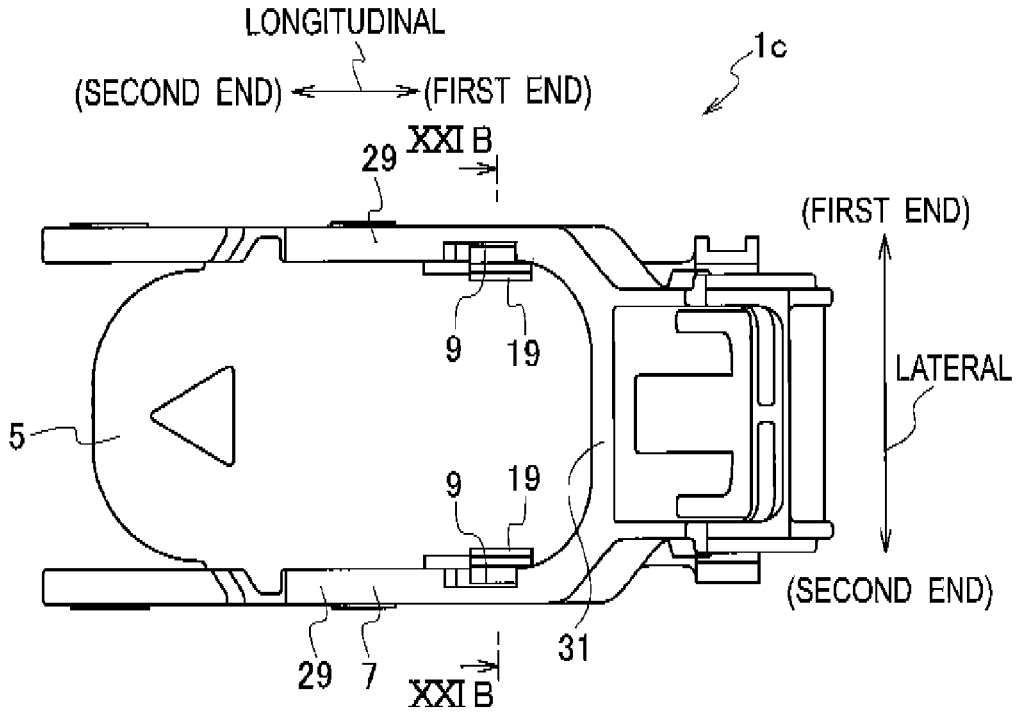
FIG. 21A is a plan view of the connector engagement body (lever in a predetermined middle position), according to the fourth embodiment.
Figure 21B:
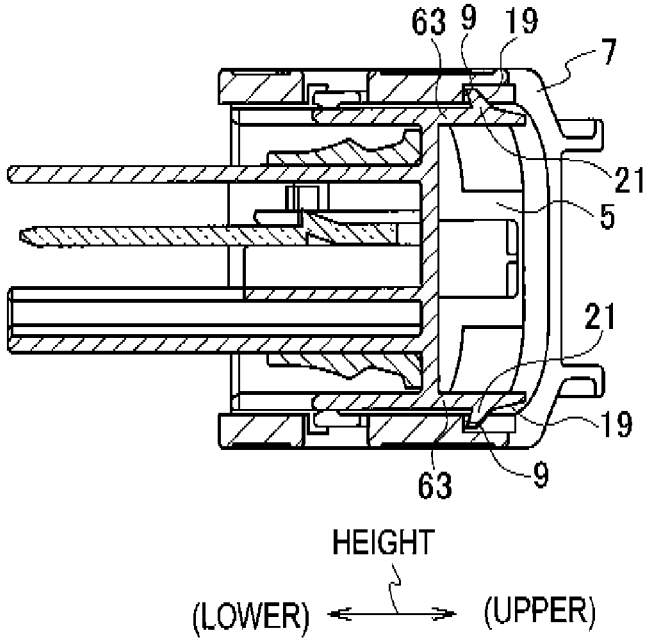
FIG. 21B is a cross sectional view taken along the line XXIB-XXIB in FIG. 21A.
Figure 22A:
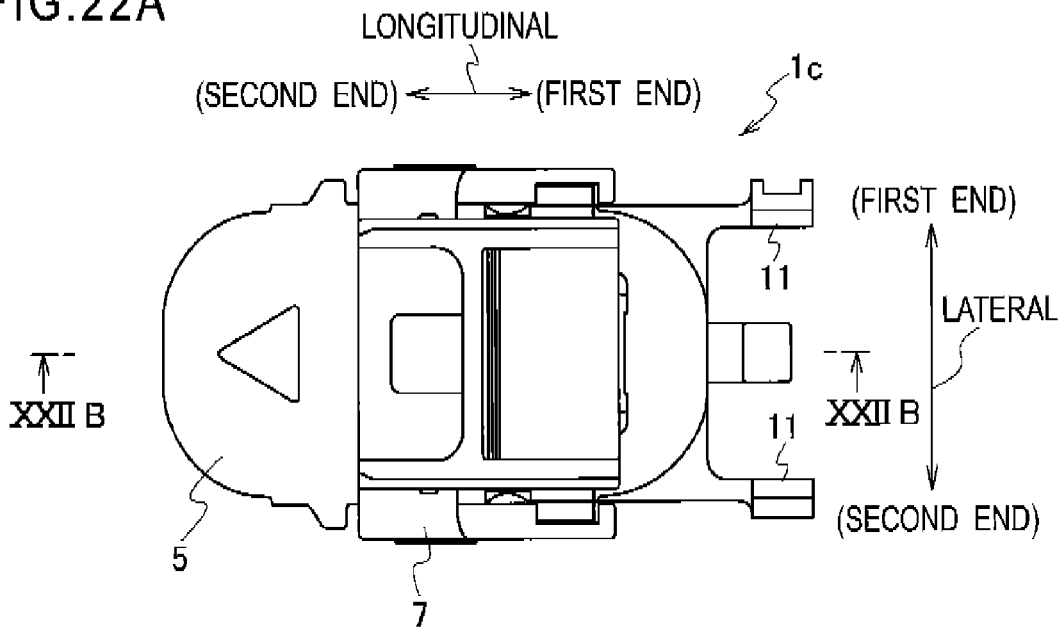
FIG. 22A is a plan view of the connector engagement body (lever in the separated position), according to the fourth embodiment.
Figure 22B:
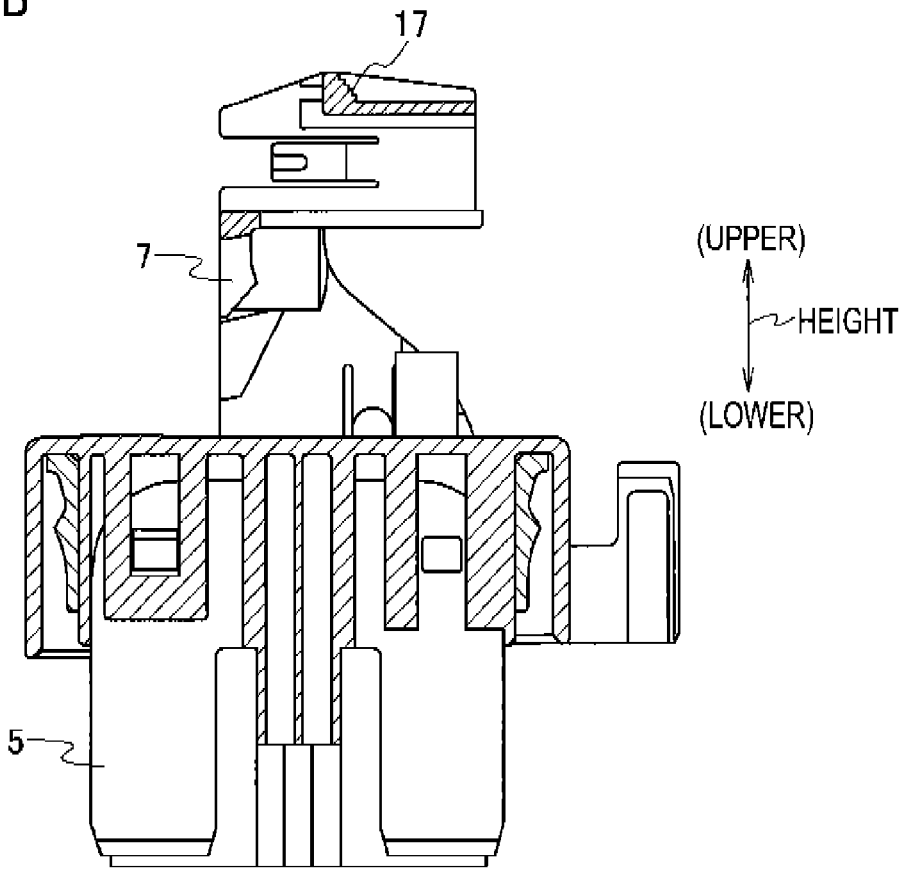
FIG. 22B is a cross sectional view taken along the line XXIIB-XXIIB in FIG. 22A.
Figure 23:
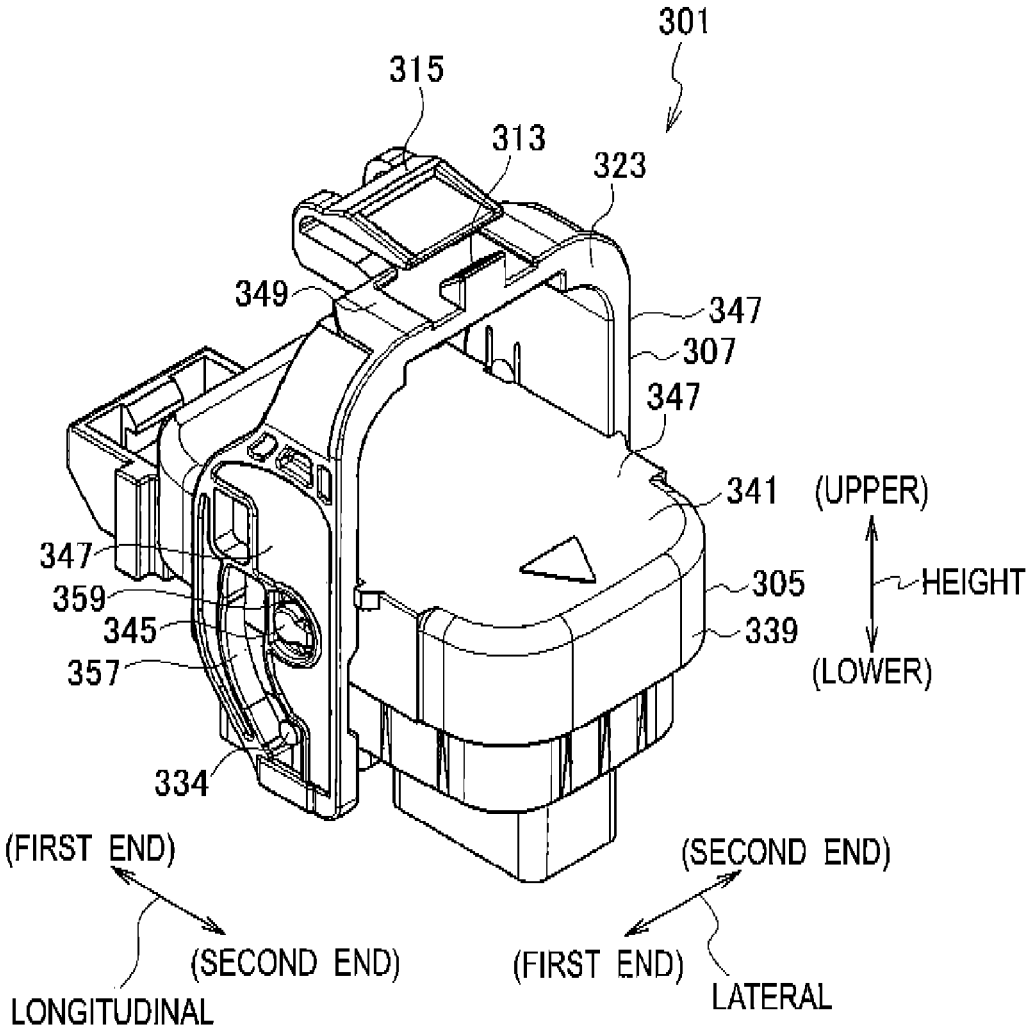
FIG.23 PRIOR ART
FIG. 23 is a perspective view of a conventional connector engagement body (lever in a separated position).
Figure 24A:
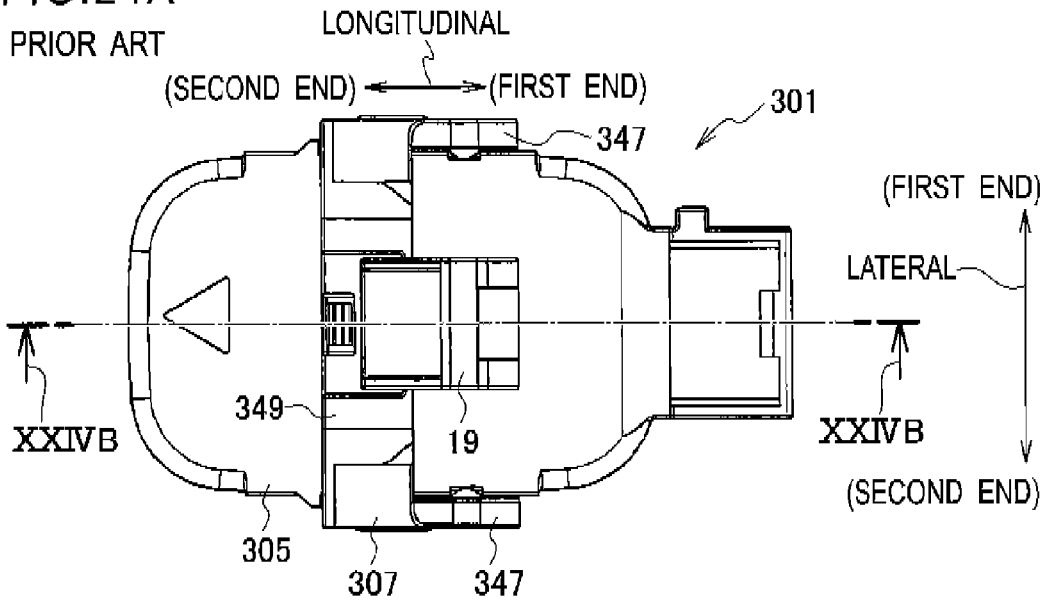
FIG.24A PRIOR ART
FIG. 24A is a plan view of the conventional connector engagement body (lever in the separated position)
Figure 24B:
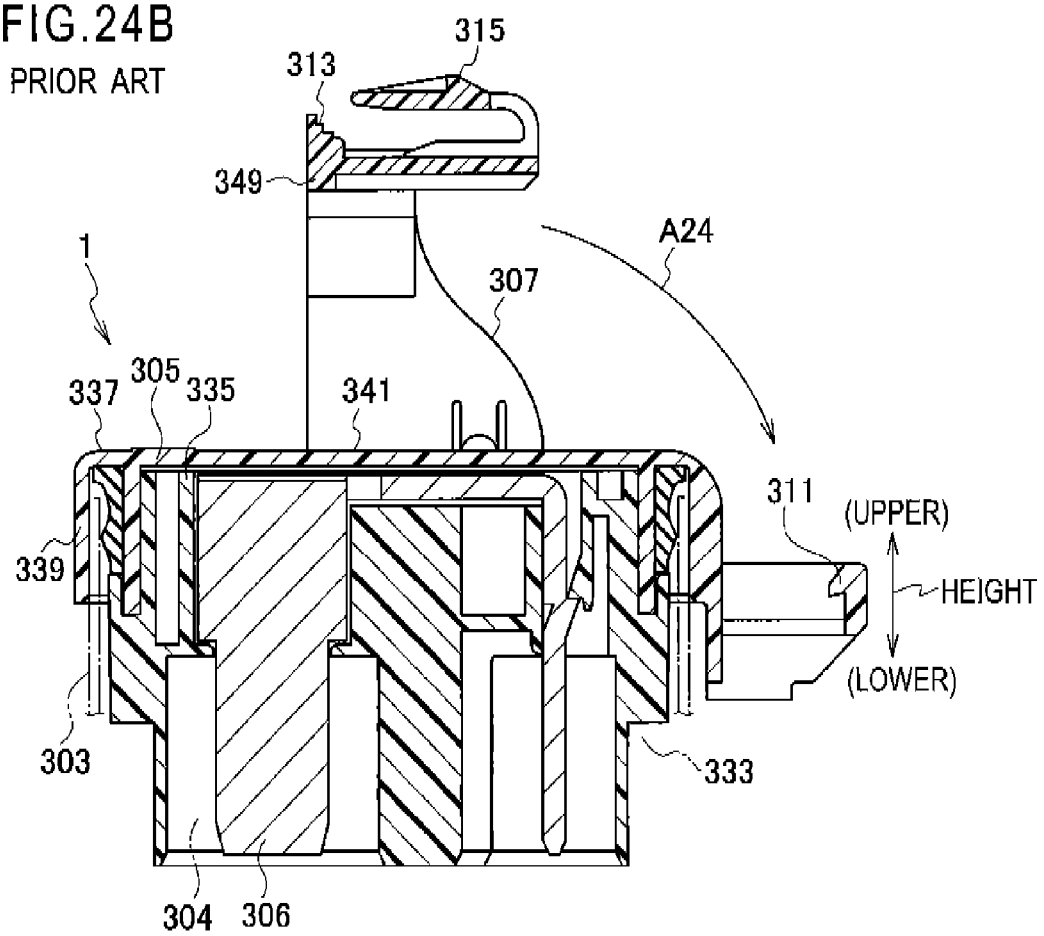
FIG.24B PRIOR ART
FIG. 24B is a cross sectional view taken along the line XXIVB-XXIVB in FIG. 24A.
Figure 25A:
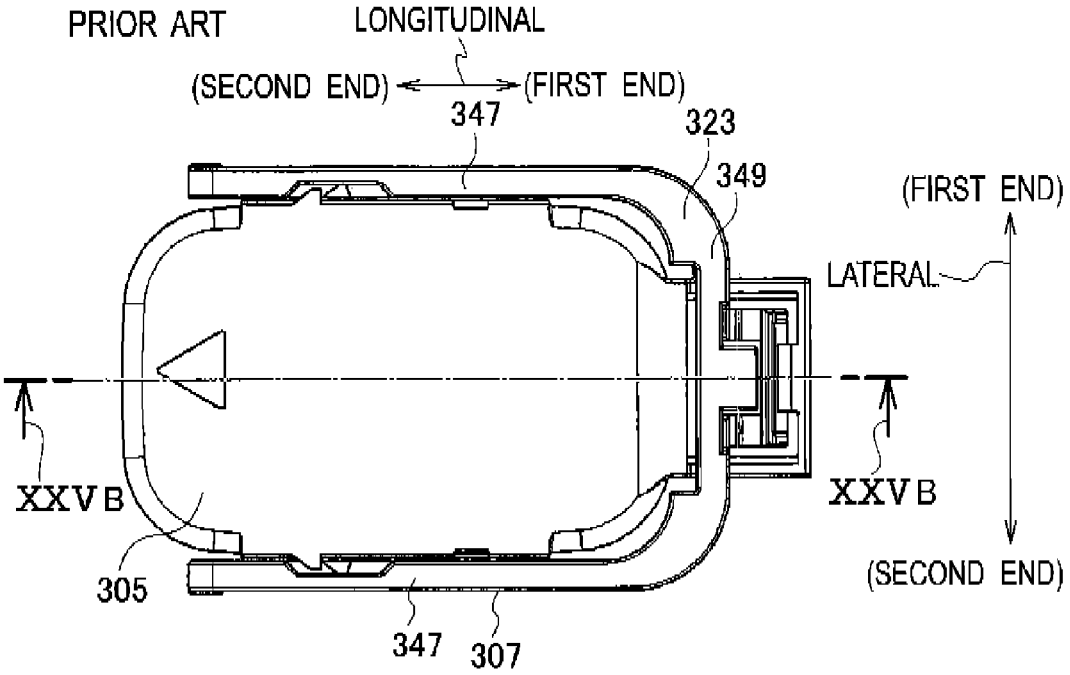
FIG.25A PRIOR ART
FIG. 25A is a plan view of the conventional connector engagement body (lever in a mated position)
Figure 25B:
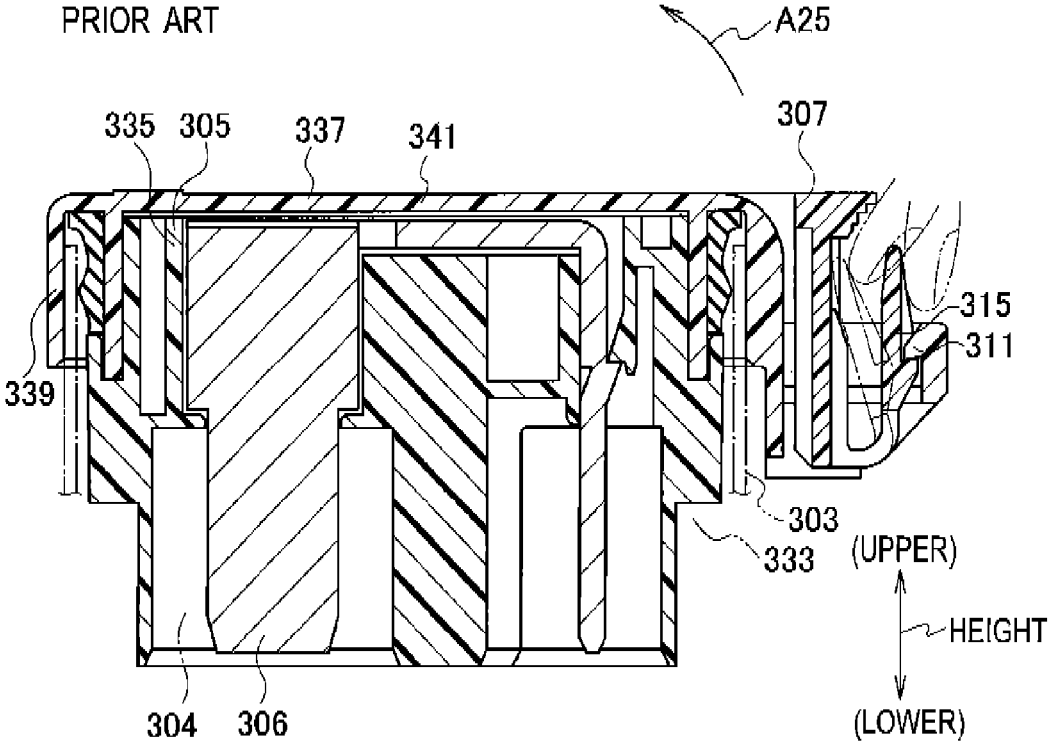
FIG.25B PRIOR ART
FIG. 25B is a cross sectional view taken along the line XXVB-XXVB in FIG. 25A.

The pair of power supply terminal locked portions 21 are formed inside the respective arm portions 29 of the lever 7. In the mated state as illustrated in FIGS. 20A and 20B and in the predetermined middle state as illustrated in FIGS. 21A and 21B, the pair of power supply terminal locked portions 21 are positioned inside the respective arm portions 29 (toward the center in the lateral direction).

Thus, it is so configured that when the pair of power supply terminal locked portions 21 are caused to be disengaged from the power supply terminal locking portions 9 of the arm portions 29 or when the pair of power supply terminal locked portions 21 are caused to be engaged with the power supply terminal locking portions 9 of the arm portions 29, the arm portions 63 of the second connector 5 are elastically deformed such that the pair of power supply terminal locked portions 21 approach each other (move toward the middle in the lateral direction).

What is claimed is:

1. A connector engagement body comprising:

a first connector comprising a first signal terminal, and a first power supply terminal;

a second connector comprising a power supply terminal locking portion, a signal terminal locking portion, a second signal terminal configured to be connected with the first signal terminal of the first connector when the second connector is mated with the first connector, and a second power supply terminal configured to be connected with the first power supply terminal of the first connector when the second connector is mated with the first connector; and a lever comprising a signal terminal releasing portion, a power supply terminal releasing portion, a power supply terminal locked portion configured to be locked to the power supply terminal locking portion of the second connector, and a signal terminal locked portion configured to be locked to the signal terminal locking portion of the second connector, the lever being configured to be engaged with the first connector and the second connector, and to cause a mating force and a separating force to act between the first connector and the second connector by moving between a mated position and a separated position relative to the first connector and the second connector, wherein when the lever is positioned in the mated position, the signal terminal locked portion is locked to the signal terminal locking portion with the first signal terminal and the second signal terminal connected with each other and the first power supply terminal and the second power supply terminal connected with each other, when the lever is positioned in a predetermined middle position between the mated position and the separated position, the first power supply terminal and the second power supply terminal are connected with each other and the first signal terminal and the second signal terminal are separated from each other, when the lever is positioned in the separated position, the first power supply terminal and the second power supply terminal are separated from each other and the first signal terminal and the second signal terminal are separated from each other, when the lever is positioned in the mated position, applying a force to the signal terminal releasing portion disengages the signal terminal locked portion from the signal terminal locking portion, thereby allowing the lever to be rotatable to the predetermined middle position, and when the lever is positioned in the predetermined middle position, applying a force to the power supply terminal releasing portion disengages the power supply terminal locked portion from the power supply terminal locking portion, thereby allowing the lever to be rotatable to the separated position.

2. The connector engagement body according to claim 1, wherein the lever includes a lever side lock interference portion, and with the lever positioned in the mated position, applying a force to the power supply terminal releasing portion allows the lever side lock interference portion to be engaged with the power supply terminal locking portion, thereby disenabling the lever to rotate.

3. The connector engagement body according to claim 1, wherein the signal terminal locked portion, the power supply terminal locked portion, and the power supply terminal releasing portion are formed at a distal end portion of an elastic portion extending from the lever.

4. A connector engagement body, comprising:

a first connector comprising a first signal terminal, and a first power supply terminal;

a second connector comprising a power supply terminal releasing portion, a power supply terminal locked portion, a signal terminal locked portion, a second signal terminal configured to be connected with the first signal terminal of the first connector when the second connector is mated with the first connector, and a second power supply terminal configured to be connected with the first power supply terminal of the first connector when the second connector is mated with the first connector; and a lever comprising a signal terminal releasing portion, a power supply terminal locking portion to which the power supply terminal locked portion of the second connector is locked, and a signal terminal locking portion to which the signal terminal locked portion of the second connector is locked, the lever being configured to be engaged with the first connector and the second connector and to cause a mating force and a separating force to act between the first connector and the second connector by moving between a mated position and a separated position relative to the first connector and the second connector, wherein when the lever is positioned in the mated position, the signal terminal locked portion is locked to the signal terminal locking portion with the first signal terminal and the second signal terminal connected with each other and the first power supply terminal and the second power supply terminal connected with each other, when the lever is positioned in a predetermined middle position between the mated position and the separated position, the first power supply terminal and the second power supply terminal are connected with each other and the first signal terminal and the second signal terminal are separated from each other, when the lever is positioned in the separated position, the first power supply terminal and the second power supply terminal are separated from each other and the first signal terminal and the second signal terminal are separated from each other, when the lever is positioned in the mated position, applying a force to the signal terminal releasing portion disengages the signal terminal locked portion from the signal terminal locking portion, thereby allowing the lever to be rotatable to the predetermined middle position, and when the lever is positioned in the predetermined middle position, applying a force to the power supply terminal releasing portion disengages the power supply terminal locked portion from the power supply terminal locking portion, thereby allowing the lever to be rotatable to the separated position.

5. The connector engagement body according to claim 4, wherein the lever includes a movable lock stopper, and with the lever positioned in the mated position, the power supply terminal releasing portion abuts the movable lock stopper, making the power supply terminal locked portion immovable by a force applied to the power supply terminal releasing portion.

6. A connector engagement body, comprising:

a first connector comprising a first signal terminal, and a first power supply terminal;

a second connector comprising a signal terminal locking portion, a power supply terminal locked portion, a power supply terminal releasing portion, a second signal terminal configured to be connected with the first signal terminal of the first connector when the second connector is mated with the first connector, a second power supply terminal configured to be connected with the first power supply terminal of the first connector when the second connector is mated with the first connector; and a lever comprising a signal terminal releasing portion, a power supply terminal locking portion to which the power supply terminal locked portion of the second connector is locked, and a signal terminal locked portion configured to be locked to the signal terminal locking portion of the second connector, the lever being configured to be engaged with the first connector and the second connector and to cause a mating force and a separating force to act between the first connector and the second connector by moving between a mated position and a separated position relative to the first connector and the second connector, wherein when the lever is positioned in the mated position, the signal terminal locked portion is locked to the signal terminal locking portion with the first signal terminal and the second signal terminal connected with each other and the first power supply terminal and the second power supply terminal connected with each other, when the lever is positioned in a predetermined middle position between the mated position and the separated position, the first power supply terminal and the second power supply terminal are connected with each other and the first signal terminal and the second signal terminal are separated from each other, when the lever is positioned in the separated position, the first power supply terminal and the second power supply terminal are separated from each other and the first signal terminal and the second signal terminal are separated from each other, when the lever is positioned in the mated position, applying a force to the signal terminal releasing portion disengages the signal terminal locked portion from the signal terminal locking portion, thereby allowing the lever to be rotatable to the predetermined middle position, and when the lever is positioned in the predetermined middle position, applying a force to the power supply terminal releasing portion disengages the power supply terminal locked portion from the power supply terminal locking portion, thereby allowing the lever to be rotatable to the separated position.

7. The connector engagement body according to claim 6, wherein the lever comprises a pair of arm portions and a connecting portion connecting the pair of arm portions with each other forming a U-like shape, and the lever is configured to be rotatable relative to the second connector around a predetermined axis, and each of the arm portions is provided with the power supply terminal locking portion.

* * * * *